United States Patent [19]

Kurosawa et al.

[11] Patent Number: 4,975,127

[45] Date of Patent: Dec. 4, 1990

[54] METHOD OF PRODUCING GRAIN ORIENTED SILICON STEEL SHEETS HAVING MAGNETIC PROPERTIES

[75] Inventors: Mitsumasa Kurosawa; Masayuki Sakaguchi; Katsuo Iwamoto; Yoshinori Kobayashi; Yoshiaki Iida, all of Chiba, Japan

[73] Assignee: Kawasaki Steel Corp., Kobe, Japan

[21] Appl. No.: 190,280

[22] Filed: May 4, 1988

[51] Int. Cl.[5] ..... H01F 1/04

[52] U.S. Cl. ..... 148/111; 148/113

[58] Field of Search ..... 148/111, 112, 113

[56] References Cited

U.S. PATENT DOCUMENTS

| | | | |
|---|---|---|---|
| 3,392,063 | 7/1968 | Kohler | 148/113 |
| 3,990,923 | 11/1976 | Takashina et al. | 148/111 |
| 4,437,910 | 3/1984 | Nozawa et al. | 148/111 |
| 4,545,828 | 10/1985 | Schoen et al. | 148/111 |

*Primary Examiner*—Melvyn J. Andrews

*Attorney, Agent, or Firm*—Austin R. Miller

[57] ABSTRACT

The magnetic properties, particularly magnetic flux density of a grain oriented silicon steel sheet are considerably improved by continuously and/or stepwise forming regions, wherein a temperature difference of a secondary recrystallization starting temperature in widthwise direction and/or longitudinal direction of the steel sheet is within a range of 10° C. to 200° C., in the steel sheet at a stage before the secondary recrystallization annealing step.

11 Claims, 12 Drawing Sheets

METHOD OF PRODUCING GRAIN ORIENTED SILICON STEEL SHEETS HAVING MAGNETIC PROPERTIES

BACKGROUND OF THE INVENTION

1. Field of the Invention

This invention relates to a method of producing a grain oriented silicon steel sheet having excellent magnetic properties, and more particularly to an improvement of magnetic flux density among the magnetic properties in the grain oriented silicon steel sheet.

2. Related Art Statement

In the grain oriented silicon steel sheet mainly used as a core material for transformers and the like, it is required that the magnetic flux density obtained at a predetermined magnetization force be high and also the iron loss obtained at a predetermined magnetic flux density be low. In this connection, the magnetic flux density $B_8$ (T: tesla) at the magnetization force of 800 A/m and the iron loss $W_{17/50}$ (W/kg) at the magnetic flux density of 1.70 T and the frequency of 50 Hz are generally adopted.

In order to improve the magnetic properties inclusive of the above two properties, many studies have been made up to the present. Particularly, good results are obtained to a certain extent by the adjustment of chemical composition in the starting material, improvements of hot rolling process, cold rolling process and heat treatment, and the like.

Heretofore, good magnetic properties of the grain oriented silicon steel sheet have been obtained by hot rolling a starting material of a low carbon steel containing usually 2.5~4.5 wt % (hereinafter merely shown by %) of Si and a slight amount of an inhibitor forming element such as Mn, S, Se, Sb, Al, Sn, N, B or the like, subjecting the hot rolled sheet to a heavy cold rolling step or to a combination of two cold rolling steps and an intermediate annealing between the two cold rolling steps, subjecting the cold rolled sheet to a decarburization and primary recrystallization annealing, subjecting the annealed sheet to a secondary recrystallization annealing is a final annealing step to highly align the secondary recrystallized grains into {110}<001> orientation, and then subjecting the final annealed sheet to a purification annealing to remove the impurities from the steel sheet.

In this case, as the orientation of the secondary recrystallized grain becomes aligned into {110}<001>, the magnetic flux density of the steel sheet becomes higher, but the secondary recrystallized grain is apt to become coarse and consequently the width of magnetic domain in the crystal grain becomes wider to increase the eddy current loss, which tends to degrade the iron loss property. Therefore, there are made various attempts for the purpose of making the secondary recrystallized grains fine. For example, Japanese Patent laid open No. 60-89,521 proposes a method of improving the iron loss property by alternately arranging an acceleration region and a delay region for the recrystallization to increase the occurrence of secondary recrystallized grain and prevent the growth thereof to thereby make the secondary recrystallized grain fine. However, the technique for magnetic domain refinement has recently been established by physical introduction of local strain, whereby the low iron loss is obtained without formation of fine secondary recrystallized grains. As a result, a trend of the technical development is to improve the magnetic flux density.

In this connection, Japanese Patent Application Publication No. 58-50,295 discloses a method of obtaining a high magnetic flux density by giving a onedirectional temperature gradient in the secondary recrystallization to selectively grow secondary recrystallized grains of {110}<001> orientation. In this method, however, the temperature control is very difficult, so that such a method can not be said to be practical.

SUMMARY OF THE INVENTION

It is, therefore, an object of the invention to advantageously solve the aforementioned problems of the conventional techniques and to provide a method of advantageously producing a grain oriented silicon steel sheet which can preferentially and selectively grow secondary recrystallized grains of {110}<001> orientation under very easy temperature control and hence can provide a higher magnetic flux density.

The inventors have made various studies for solving the above problems and found that the secondary recrystallized grains of {110}<001> orientation can preferentially and selectively be grown by controlling the secondary recrystallization starting temperature of the steel sheet even if the temperature gradient in the secondary recrystallization is not controlled and hence the high magnetic flux density can be obtained, and as a result the invention has been accomplished.

According to the invention, there is the provision of a method of producing a grain oriented silicon steel sheet having excellent magnetic properties by a series of steps of hot rolling a slab of silicon containing steel, subjecting the hot rolled sheet to a heavy cold rolling step or to a combination of two cold rolling steps through and an intermediate annealing between the two cold rolling steps to obtain a final sheet gauge, subjecting the cold rolled sheet to decarburization and primary recrystallization annealing, applying a slurry of an annealing separator to the surface of the steel sheet, and thereafter subjecting the steel sheet to a secondary recrystallization annealing and further to a purification annealing, characterized in that at a stage before the secondary recrystallization annealing step, a region wherein a temperature difference of a secondary recrystallization starting temperature in widthwise direction and/or longitudinal direction of the steel sheet is continuously and/or stepwise within a range of 10° C. to 200° C. is formed in the steel sheet.

BRIEF DESCRIPTION OF THE DRAWINGS

The invention will be described with reference to the accompanying drawings, wherein.

DESCRIPTION OF THE PREFERRED EMBODIMENT

Figure 1:
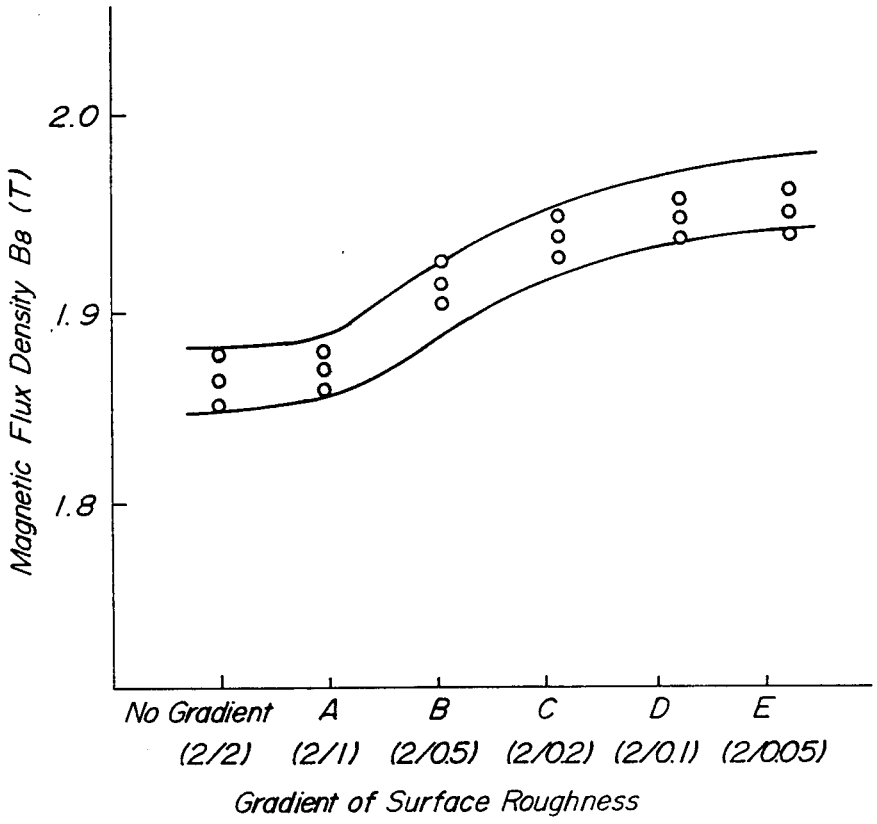
FIG. 1 is a graph showing a relation between a gradient of surface roughness of a rolling roll drum and a magnetic flux density $B_8$.
Figure 2A:
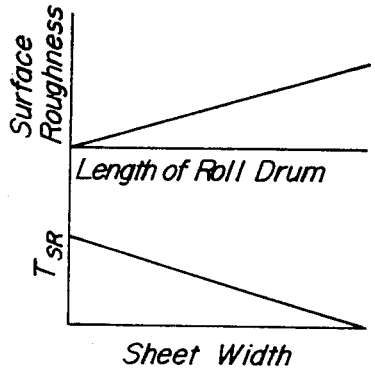
FIGS. 2*a* to 2*h* are graphs showing a relation between a surface roughness of a roll drum and a secondary recrystallization starting temperature, respectively.
Figure 2B:
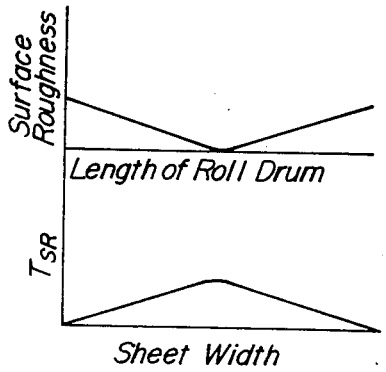
Figure 2C:
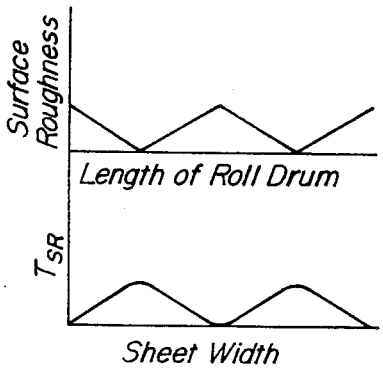
Figure 2D:
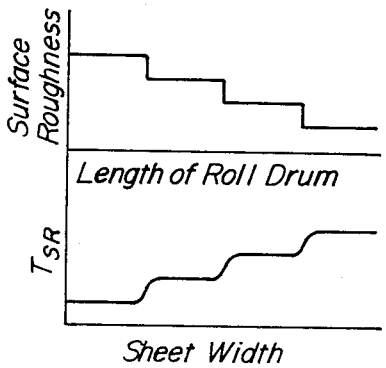
Figure 2E:
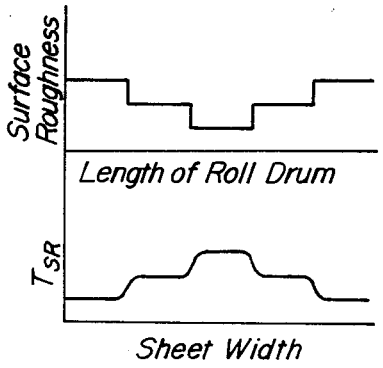
Figure 2F:
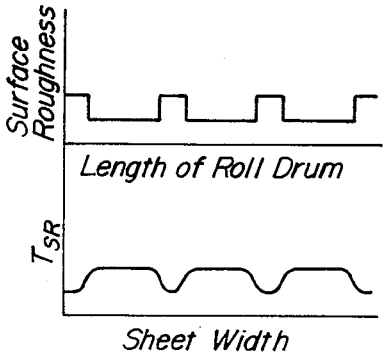
Figure 2G:
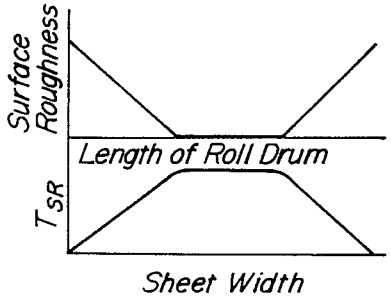
Figure 2H:
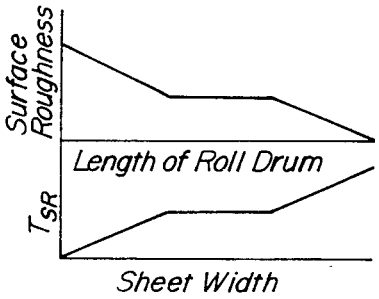

The invention will be described with respect to investigational details resulting in the success of the invention.

Heretofore, as the frequency of nucleus formation for the secondary recrystallized grain was made high to form fine secondary recrystallized grains for reducing the iron loss, it was impossible to avoid the decrease of the magnetic flux density due to the increase of the displacement from the {110}<001> orientation. For this end, the secondary recrystallization annealing treatment was carried out by uniformly holding the annealing temperature at a certain value, whereby the nucleus of {110}<001> orientation could preferentially be produced to conduct the formation of fine secondary recrystallized grains without damaging the magnetic flux density. Furthermore, in order to enhance the magnetic flux density, the primary grains of the other orientation were coalesced by the secondary grains after the nucleus formation of {110}<001> orientation, whereby the secondary recrystallization structure having a highly aligned {110}<001> orientation and a high magnetic flux density was obtained.

In the conventional grain oriented silicon steel sheet, however, since the frequency of nucleus formation for secondary recrystallized grain was high, the grains of {110}<001> orientation could not sufficiently and selectively be grown.

In this connection, the inventors have made investigations and found that the previously formed grains of {110}<001> orientation can selectively be grown by locally shifting a time of forming nucleus of {110}<001> orientation in the steel sheet and consequently the secondary recrystallization structure having a very high magnetic flux density is obtained.

In the grain oriented silicon steel sheet, the secondary recrystallization starting temperature is generally within a range of 800°~1,000° C. This temperature inherent to the steel sheet is determined by the chemical composition of the steel and the manufacturing steps. The term "secondary recrystallization starting temperature" used herein indicates a temperature that the secondary recrystallized grains are produced when the steel sheet subjected to decarburization and primary recrystallization annealing after the final cold rolling is held at a constant temperature for 20 hours. In general, the secondary recrystallization can be completed by performing the annealing at a temperature above the secondary recrystallization starting temperature for a long time. In the invention, however, it is a great feature that prior to the secondary recrystallization annealing, the secondary recrystallization starting temperature of the steel sheet is controlled so as to have a temperature difference within a range of 10° C.~200° C. in the sheet, whereby the secondary recrystallized grains of {110}<001> orientation are first and preferentially produced from a region having a low secondary recrystallization temperature and subsequently grown into big grains through the coalescing thereof before the formation of secondary recrystallized grain at the other regions to thereby complete the secondary recrystallization. In this case, the size of the secondary recrystallized grain is dependent upon the distribution state of the secondary recrystallization temperature, so that the control of the secondary recrystallization structure is made possible by controlling the temperature difference in the secondary recrystallization temperature of the steel sheet while maintaining the high magnetic flux density.

Moreover, it is difficult to give a temperature difference of higher than 200° C. to the secondary recrystallization starting temperature of the steel sheet, so that the temperature difference is limited to not higher than 200° C.

As a factor exerting on the secondary recrystallization starting temperature in the manufacturing steps, it is considered that all factors affecting the structure and crystal grain size after the primary recrystallization, such as rolling reduction, heating rate in primary recrystallization and the like exert on the secondary recrystallization starting temperature. Therefore, it is considered that the secondary recrystallization starting temperature can be controlled by largely changing these factors locally in the steel sheet.

The inventors have made studies with respect to a means for changing the secondary recrystallization starting temperature (hereinafter abbreviated as $T_{SR}$) and found that the friction coefficient of the rolling roll in the cold rolling is closely related to $T_{SR}$.

That is, when the friction coefficient of the rolling roll in the cold rolling is high, the deformation behavior in the rolling changes and finally $T_{SR}$ lowers, while when it is small, $T_{SR}$ rises.

A slab of silicon steel having a composition of C: 0.045%, Si: 3.30%, Mn: 0.07%, P: 0.01%, S: 0.005%, Al: 0.001%, Se: 0.020%, Sb: 0.025% and Mo: 0.012% was hot rolled to a thickness of 2.0 mm, which was subjected to a two-time cold rolling through an intermediate annealing at 950° C. for 3 minutes to obtain a cold rolled sheet having a final gauge of 0.23 mm. In this case, at least one pass rolling before the final pass in the cold rolling was carried out by using a rolling roll with a gradient of friction coefficient variously changed in widthwise direction of the roll. That is, the gradient of friction coefficient was given by specifying a surface roughness at an end of the roll drum (center-line average roughness Ra=2.0 μm) as a standard and lessening a surface roughness toward the other end thereof to 1.0 μm (A), 0.5 μm (B), 0.2 μm (C), 0.1 μm (D) and 0.05 μm (E).

Then, the thus cold rolled sheet was subjected to decarburization and primary recrystallization annealing at 850° C. in a wet hydrogen atmosphere for 3 minutes, coated with a slurry of an annealing separator, and then coiled, and subjected to secondary recrystallization by heating at a temperature rising rate of 5° C./hr over a range of 800° C.~1,000° C. and further to a purification annealing at 1,200° C. in a dry hydrogen atmosphere for 5 hours.

The magnetic properties of the thus obtained sheet product were examined to obtain results shown in FIG. 1 as a relation to the gradient of friction coefficient.

As seen from FIG. 1, the magnetic flux density is improved by giving the gradient of friction coefficient to the rolling roll, and a particularly good result is obtained when the difference of the gradient between both ends of the roll drum is not less than 5 times Ra.

The method according to the invention will be described in order of the manufacturing steps below.

As a base metal, there may be advantageously used any of conventionally well-known silicon steel compositions, an example of which is a silicon steel comprising C: 0.005~0.15%, Si: 0.1~7.0% and Mn: 0.002~0.15% and containing at least one inhibitor-forming element selected from the group consisting of S: 0.005~0.05%, Se: 0.005~0.05%, Te: 0.003~0.03%, Sb: 0.005~0.05%, Sn: 0.03~0.5%, Cu: 0.02~0.3%, Mo: 0.005~0.05%, B: 0.0003~0.004%, N: 0.001~0.01%, Al: 0.005~0.05% and Nb: 0.001~0.05%.

These base metals are melted in the conventionally well-known steel making furnace such as converter, electric furnace or the like and then shaped into a slab, a sheet bar or a thin steel sheet in an ingot making process, a continuous casting process or a roll quenching process, which is subjected to hot rolling and warm or cold rolling to form a silicon containing steel sheet, if necessary. Then, the steel sheet is subjected to a normalized annealing and further one or more rollings through an intermediate annealing up to a final sheet gauge, if necessary. The normalized annealing and the intermediate annealing serve as a recrystallization for homogenizing crystal structure after the rolling, and are usually carried out by holding a temperature of 800°~1,200° C. for 30 seconds to 10 minutes. Furthermore, the final gauge is not more than 0.50 mm. Particularly, the invention is effective at a final gauge of not more than 0.23 mm otherwise the secondary recrystallization may be unstable.

According to this embodiment of the invention, it is necessary that at least one pass rolling before the final pass in the cold rolling is performed by using a rolling roll with a gradient or stepwise difference of friction coefficient in the lengthwise direction of roll drum.

When the difference of the friction coefficient is formed in the roll, the change of not less than 4 times Ra is required. When Ra does not satisfy this requirement, the difference of $T_{SR}$ of not lower than 10° C. is not obtained.

Then, the thus treated steel sheet is subjected to an annealing at 700°~900° C. in a wet hydrogen atmosphere for about 1~15 minitues, whereby C included in steel is removed and also a primary recrystallization structure useful for forming secondary recrystallized grains of Goss orientation in the subsequent annealing is formed.

Next, the steel sheet is coated with a slurry of an annealing separator and coiled and then is subjected to a secondary recrystallization annealing. As the secondary recrystallization annealing, an annealing by heating at a temperature rising rate of not higher than 10° C./hr over a range of from a minimum temperature starting the secondary recrystallization to a temperature completing the secondary recrystallization (usually about 800°~1,000° C.), and an annealing by constantly holding at a minimum temperature region starting the secondary recrystallization till the secondary recrystallization is completed are particularly useful. Moreover, the reason why the temperature rising rate is limited to not higher than 10° C./hr is due to the fact that when the temperature rising rate is higher than 10° C./hr, the nucleus formation and growth for secondary recrystallized grain are rapidly and undesirably caused to impede the selective growth of {110}<001> orientation.

Thereafter, the sheet is subjected to a purification annealing at 1,100°~1,300° C. in a dry hydrogen atmosphere for about 5~25 hours.

The effective enhancement of the magnetic properties can be achieved by performing such a series of these treatments, but according to the invention, more improvement of the magnetic properties can be achieved by forming a tension-applied type extremely thin coating on the surface of the steel sheet after the purification annealing.

In order to form such a coating, non-metallic substances are first removed from the steel sheet surface after the purification annealing, and then the steel sheet is subjected to a chemical polishing or an electrolytic polishing to render the smoothness of the surface into not more than 0.4 μm as a center-line average roughness Ra. When Ra exceeds 0.4 μm, the improving effect of the iron loss is not expected even by the subsequent coating formation.

The extremely thin coating composed mainly of at least one of nitrides and/or carbides of Ti, Nb, Si, V, Cr, Al, Mn, B, Ni, Co, Mo, Zr, Ta, Hf and W and oxides of Al, Si, Mn, Mg, Zn and Ti is strongly adhered to the surface of the steel sheet through a deposition process such as CVD process or PVD process (ion plating or ion implantation).

As the material of the coating, use may be made of any materials having a low thermal expansion coefficient and a strong adhesion property to the steel sheet in addition to the above materials.

If necessary, a tension-applied type low thermal expansion insulative topcoat is further formed in the conventional manner.

In general, a roll having a large surface roughness, which is called as a dull roll, is considered as a roll having a large friction coefficient. When the final rolling is performed by using such a dull roll, the slipping between the roll surface and the steel sheet surface is restrained to increase the shearing deformation of the steel sheet, whereby the cold rolling texture is changed. That is, the {110}<001> orientation is increased as a structure after the primary recrystallization to lower $T_{SR}$.

On the other hand, when the final rolling is performed by using a rolling roll having a very small surface roughness, which is called as a bright roll, $T_{SR}$ rises owing to reasons opposite to the above.

According to this embodiment of the invention, the surface roughness or friction coefficient of the rolling roll is changed in the longitudinal direction of the roll drum, whereby $T_{SR}$ of the steel sheet after the final cold rolling is made different in the widthwise direction of the sheet, so that in the subsequent secondary recrystallization annealing, the secondary recrystallized grains of {110}<001> orientation are first and preferentially produced from the region having the low secondary recrystallization starting temperature, while the primary recrystallized grains are coalesced by the above secondary recrystallized grains at the region having the high secondary recrystallization starting temperature before such primary grains are changed into secondary recrystallized grains, and consequently a structure highly aligned into {110}<001> orientation is finally formed and hence the high magnetic flux density is obtained.

FIGS. *2a*~*2h* illustrate a relation between surface roughness formed in the longitudinal direction of roll drum according to the invention and distribution state of secondary recrystallization starting temperature ($T_{SR}$) of steel sheet rolled by using such a roll, respectively.

FIGS. *2a* to *2c* are a case of continuously changing the surface roughness of the roll, respectively, and FIGS. *2d* to *2f* are a case of stepwise changing the surface roughness of the roll, respectively, and FIGS. *2g* and *2h* are a case of continuously and stepwise changing the surface roughness of the roll, respectively.

As previously mentioned, it is necessary that Ra the difference of friction coefficient is not less than 4 times.

Although the method of adjusting the surface roughness of the rolling roll has mainly been described as a method of controlling the secondary recrystallization starting temperature $T_{SR}$, the invention is not intended to the limitation thereof. That is, the invention may use any methods capable of controlling $T_{SR}$. For instance, there are mentioned a method of performing local heating in the annealing, a method of locally changing C content before the final cold rolling, a method of applying slurries having different annealing separator concentrations to different regions, and the like.

These methods will also be described in order below.

At first, the inventors have noticed the temperature in the intermediate annealing and made studies thereto.

Figure 3:
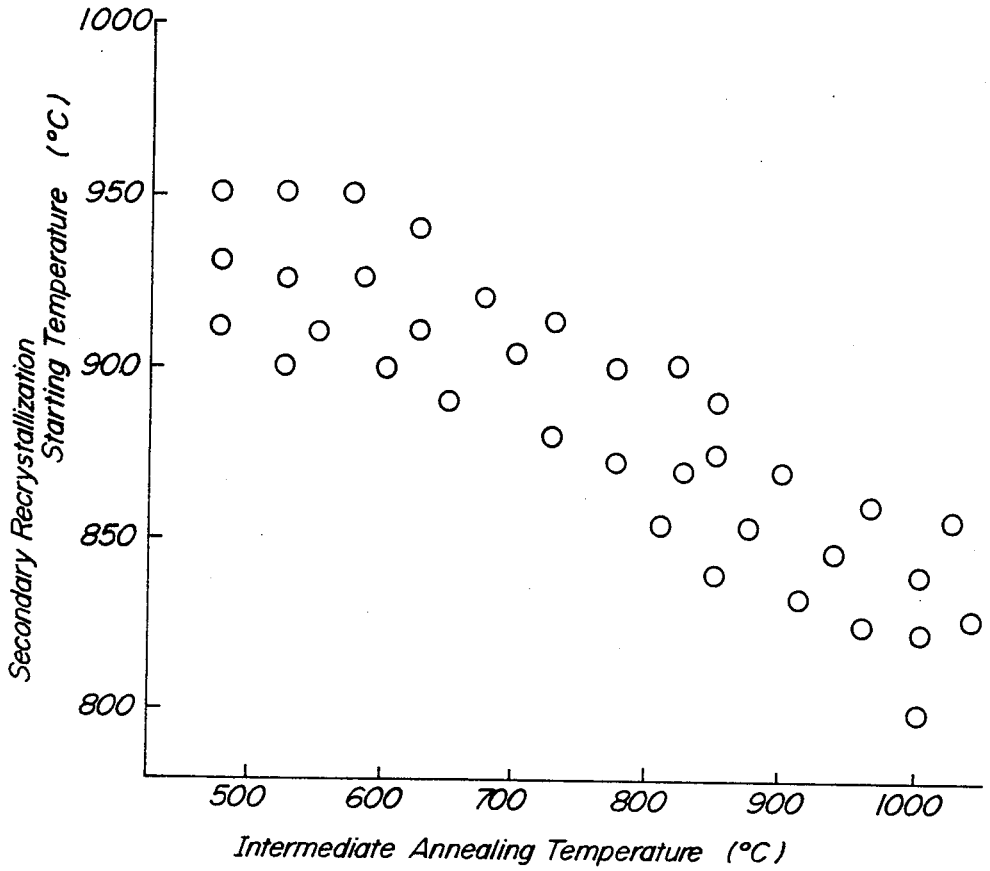
FIG. 3 is a graph showing a relation between an intermediate annealing temperature and a secondary recrystallization starting temperature.

As a result, it has been found that there is a relation shown in FIG. 3 between the intermediate annealing temperature and the secondary recrystallization starting temperature.

FIG. 3 shows an example of changing the secondary recrystallization starting temperature when the temperature in the intermediate annealing between the first and second cold rollings is varied in the manufacture of grain oriented silicon steel sheets. As seen from FIG. 3, the secondary recrystallization starting temperature changes together with the change of the intermediate annealing temperature, s that the difference of the secondary recrystallization starting temperature can locally be produced by locally changing the intermediate annealing temperature in the steel sheet.

Namely, in the intermediate annealing, the regions having different annealing temperatures are continuously or stepwise formed in the widthwise and/or longitudinal direction of the steel sheet to produce regions having different secondary recrystallization starting temperatures, whereby secondary recrystallized grains of {110}<001> orientation are preferentially produced from the region having a high intermediate annealing temperature and hence a low secondary recrystallization starting temperature and then grown into big grains due to the coalescing thereof at the region having a low intermediate annealing temperature and hence a high secondary recrystallization starting temperature before the primary recrystallized grains at the latter region are changed into secondary recrystallized grains. In this way, the secondary recrystallization in the desired orientation can be completed in the widthwise and/or longitudinal direction.

In order to sufficiently obtain this effect, the difference of the secondary recrystallization starting temperature of not lower than 10° C. should be given to the steel sheet. When the temperature difference is lower than 10° C., the given effect can not be obtained. In order to provide the difference of the secondary recrystallization starting temperature of not lower than 10° C., it is important to give a temperature gradient of 200° C./m to the steel sheet when continuously changing the annealing temperature, or to render the temperature difference between the adjoining regions into not lower than 100° C. when stepwise changing the annealing temperature.

For example, the method of giving the difference of the secondary recrystallization starting temperature to the steel sheet is as follows.

That is, a continuous annealing furnace having a large temperature difference in the widthwise direction of the sheet may be used, or the annealing temperature may be changed in the longitudinal direction of the sheet. Furthermore, there is a new method wherein only an arbitrary portion of the steel sheet is heated at a high temperature by using a local heating apparatus such as a laser heating apparatus or the like. In addition, there may be used a method of effectively utilizing the temperature difference in the annealing of the coil with a box type annealing furnace other than the continuous annealing furnace.

The above fact will be described with reference to the following example.

A hot rolled sheet of silicon steel having a composition of C: 0.045%, Si: 3.45%, Mn: 0.070%, Se: 0.025%, Sb: 0.023% and the balance being substantially Fe was annealed, descaled, subjected to a first cold rolling and coiled. Thereafter, the resulting coil of 1,000 mm in width was subjected to an intermediate annealing in a continuous annealing furnace controlled so as to give a temperature difference in the widthwise direction of the coil by heater segments divided in the widthwise direction thereof, wherein the annealing was performed at such a temperature gradient that the annealing temperature was 1,000° C. in the central portion of the coil having a width of 40 mm and 400° C. in both side end portions thereof. Then, the sheet was subjected to a second cold rolling to provide a final sheet gauge of 0.23 mm. The thus cold rolled sheet was subjected to decarburization annealing at 825° C. for 2 minutes, coated with a slurry of an annealing separator, and subjected to a secondary recrystallization by holding the temperature at 840° C. for 70 hours and further to a purification annealing at 1,200° C. for 10 hours.

In this case, the secondary recrystallization starting temperature in the central portion of the coil was 840° C., while that in both side end portions was 920° C.

The magnetic properties of the thus obtained sheet product (symbol C) were measured to obtain results as shown in the following Table 1.

Moreover, the results on the magnetic properties of a product (symbol A) obtained by uniformly performing the intermediate annealing at 1,000° C. in the conventional method are also shown in Table 1. Furthermore, the magnetic properties when these products were subjected to magnetic domain refinement through plasma jet (symbol B, D) are also shown in Table 1.

In any case, the magnetic properties are substantially the same in the widthwise direction.

TABLE 1

| Symbol | Intermediate annealing condition | Magnetic domain refinement through plasma jet | Magnetic properties $W_{17/50}$ (W/kg) | $B_8$ (T) |
|---|---|---|---|---|
| A | conventional | absence | 0.88 | 1.899 |
| B | method | presence | 0.83 | 1.887 |
| C | invention | absence | 0.83 | 1.972 |
| D | method | presence | 0.68 | 1.961 |

Such an effect is obtained even when the annealing is performed before the final cold rolling at the heavy cold rolling as mentioned below.

That is, a hot rolled sheet of silicon steel having a composition of C: 0.053%, Si: 3.25%, Mn: 0.084%, S: 0.027%, Al: 0.030%, N: 0.0080% and the balance being substantially Fe was annealed in the same continuous annealing furnace as mentioned above at such a temperature gradient that the temperature of the coil with a width of 1,000 mm was 500° C. in a portion ranging from one end of the coil to a central portion thereof and 1,050° C. in the other end portion having a width of 25 mm, and then subjected to a heavy cold rolling at once to provide a final sheet gauge of 0.23 mm. Thereafter, the cold rolled sheet was subjected to decarburization annealing at 835° C. for 3 minutes, coated with a slurry of an annealing separator, and then subjected to secondary recrystallization by raising the temperature at a rising rate of 5° C./hr over a range of 800°~1,000° C. and further to purification annealing at 1,180° C. for 12 hours. In this case, the secondary recrystallization starting temperature of the coil annealed at 500° C. was 930° C., while that of the other end portion was 860° C.

The magnetic properties of the thus obtained sheet product (symbol C) were measured to obtain results as shown in the following Table 2.

In Table 2 are also shown results on the magnetic properties of a product (symbol A) obtained by uniformly performing the intermediate annealing at 1,050° C. in the conventional method. Furthermore, the magnetic properties when these products were mirrorfinished and provided at their surfaces with TiN coating through ion plating (symbol B, D) are also shown in Table 2.

Moreover, all of the magnetic properties are substantially the same in the widthwise direction.

TABLE 2

| Symbol | Annealing condition | TiN coating through ion plating | Magnetic properties $W_{17/50}$ (W/kg) | $B_8$ (T) |
|---|---|---|---|---|
| A | conventional | absence | 0.87 | 1.905 |
| B | method | presence | 0.72 | 1.915 |
| C | invention | absence | 0.83 | 1.980 |
| D | method | presence | 0.67 | 1.982 |

The method of changing the temperature rising condition in the decarburization and primary recrystallization annealing will be described below.

Figure 4:
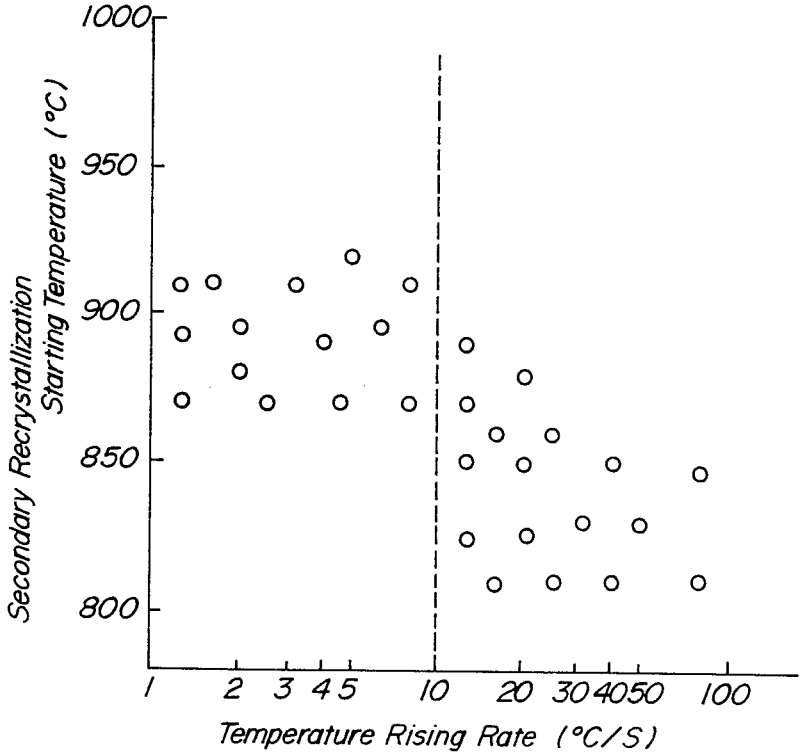
FIG. 4 is a graph showing a relation between a temperature rising rate in decarburization annealing and a secondary recrystallization starting temperature.

FIG. 4 shows an example of changing the secondary recrystallization starting temperature when the temperature rising rate is varied in the decarburization annealing in the manufacture of grain oriented silicon steel sheets. As seen from FIG. 4, there is caused a difference of secondary recrystallization starting temperature when the temperature rising rate in the decarburization annealing is 10° C./sec.

Figure 5:
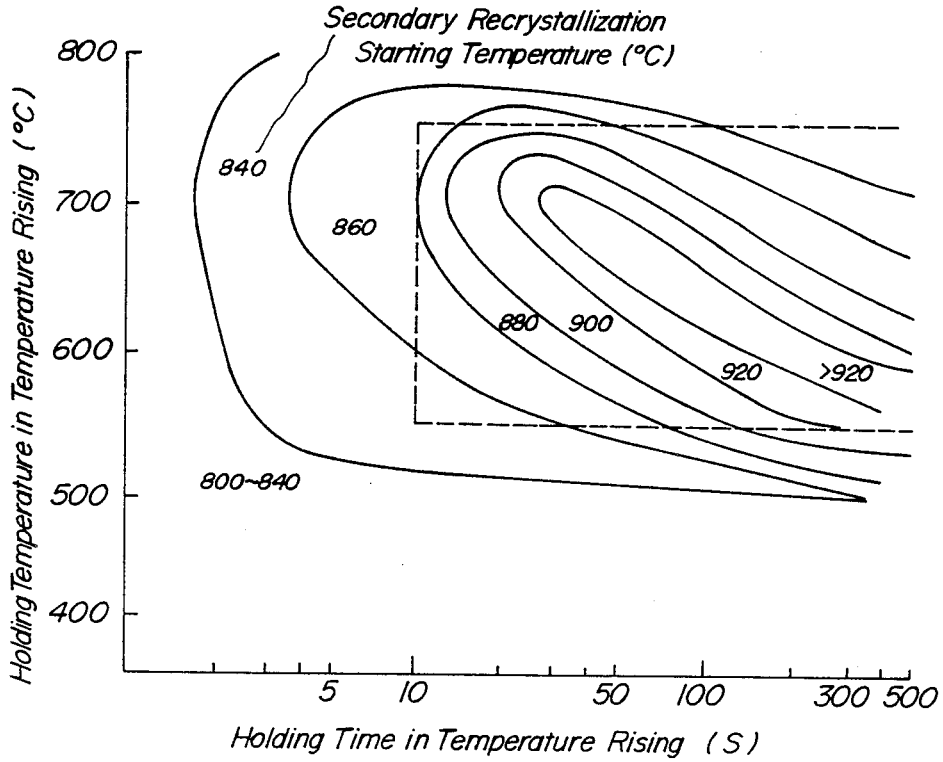
FIG. 5 is a graph showing a relation among holding temperature and time in the temperature rising for decarburization annealing and a secondary recrystallization starting temperature.

FIG. 5 shows an example of secondary recrystallization starting temperature when being subjected to a holding treatment for a short time in the course of the temperature rising during the decarburization annealing. As seen from FIG. 5, the secondary recrystallization starting temperature rises as compared with the conventional case using no holding treatment when the temperature of 550°~750° C. is held for not less than 10 seconds.

Therefore, the local difference of secondary recrystallization starting temperature can be given to the steel sheet by changing the temperature rising rate or performing the temperature holding treatment for a short time at the temperature rising stage in the decarburization annealing.

That is, regions having different temperature rising conditions are continuously or stepwise formed in the widthwise and/or longitudinal direction of the steel sheet in the decarburization annealing to form regions having different secondary recrystallization starting temperatures, whereby secondary recrystallized grains of {110}<001> orientation are preferentially produced from the region having a low secondary recrystallization starting temperature through rapid temperature rising in the decarburization annealing and grown into big grains due to the coalescing thereof before the formation of secondary recrystallized grain at the region having a high secondary recrystallization starting temperature through the slow temperature rising rate or appropriate temperature holding in the decarburization annealing, whereby the secondary recrystallization of the desired orientation can be completed in the widthwise and/or longitudinal direction. In order to sufficiently obtain such an effect, the difference of secondary recrystallization starting temperature of not lower than 10° C. should be given to the steel sheet, because when the temperature difference is lower than 10° C., the given effect can not be obtained. According to the invention, the predetermined difference of secondary recrystallization starting temperature can be ensured by rendering the temperature rising rate into not more than 10° C./sec or holding the temperature at 550°~750° C. for 10 seconds~10 minutes as the temperature rising condition of the decarburization annealing.

For example, the method of changing the temperature rising condition in the decarburization annealing is as follows.

There are a method of controlling the temperature rising condition by applying a low temperature atmosphere gas to a part of the steel sheet through a cooling nozzle arranged in the heating zone of the furnace, a method of locally performing usual rapid heating by using a local heating apparatus such as a laser heating apparatus wherein the whole of the furnace is gradually heated or heated at two stages, a method of partially annealing the steel sheet under the above condition at 2 or more times to give the difference of secondary recrystallization starting temperature to the steel sheet, and the like.

For instance, a hot rolled sheet of silicon steel having a composition of C: 0.044%, Si: 3.35%, Mn: 0.065%, Se: 0.20%, Sb: 0.023%, Mo: 0.011% and the balance being substantially Fe was annealed, descaled and subjected to a two-time cold rolling through an intermediate annealing to provide a final sheet gauge of 0.23 mm. Then, the cold rolled sheet was divided into four specimens A, B, C and D.

The specimens A and B were subjected to decarburization annealing for 2 minutes at a temperature rising rate of 20° C./sec up to 830° C., while the specimens C and D were subjected to decarburization annealing for 2 minutes in a continuous annealing furnace capable of controlling the temperature difference in the widthwise direction of the sheet coil by means of heater segments divided in the widthwise direction thereof, wherein the coil of 1,000 mm in width was heated at a temperature rising rate of 20° C./sec in the central portion having a width of 30 mm and at a temperature rising rate of 5° C./sec in both side end portions up to 830° C. Then, these specimens were coated with a slurry of an annealing separator and subjected to secondary recrystallization annealing at 835° C. for 60 hours and further to purification annealing at 1,190° C. for 7 hours. Moreover, the secondary recrystallization starting temperature in the specimens C and D was 835° C. at the central portion of the coil and 890° C. at both side end portions thereof.

Thereafter, the specimens B and D were subjected to magnetic domain refinement through laser irradiation.

The magnetic properties of these sheet products were measured to obtain results as shown in the following Table 3.

Moreover, all of the magnetic properties were substantially the same in the widthwise direction thereof.

TABLE 3

| Symbol | Decarburization annealing condition | Magnetic domain refinement through laser | Magnetic properties $W_{17/50}$ (W/kg) | $B_8$ (T) |
|---|---|---|---|---|
| A | conventional | absence | 0.87 | 1.897 |
| B | method | presence | 0.82 | 1.885 |
| C | invention | absence | 0.83 | 1.973 |
| D | method | presence | 0.68 | 1.962 |

The similar effect is obtained even in the heavy cold rolling as mentioned below.

A hot rolled sheet of silicon steel having a composition of C: 0.055%, Si: 3.45%, Mn: 0.080%, S: 0.025%, Al: 0.029%, N: 0.0082% and the balance being substantially Fe was annealed at 1,150° C., subjected to a heavy cold rolling at once to provide a final sheet gauge of 0.23 mm, and divided into four specimens A~D.

The specimens A and B were subjected to decarburization annealing for 2 minutes by raising the temperature up to 835° C. at a temperature rising rate of 17° C./sec, while the specimens C and D were subjected to decarburization annealing for 2 minutes by using a furnace capable of locally heating through laser in such a manner that the sheet coil of 1,000 mm in width was held at 650° C. for 1 minute in the central portion thereof having a width of 940 mm in the course of the temperature rising and then the temperature at both side end portions thereof was raised up to 835° C. under the same condition as in the specimens A and B. Thereafter, these specimens were coated with a slurry of an annealing separator, subjected to secondary recrystallization by raising the temperature from 800° C. to 1,000° C. at a rate of 7° C./hr and further to purification annealing at 1,200° C. for 10 hours. Moreover, the secondary recrystallization starting temperature at both side end portions in the specimens A~D was 880° C., and that at the central portion in the specimens C and D was 985° C.

Thereafter, the specimens B and D were mirror-finished and provided at their surfaces with TiN coating through CVD.

The magnetic properties of these sheet products were measured to obtain results as shown in the following Table 4.

Moreover, all of the magnetic properties were substantially the same in the widthwise direction thereof.

TABLE 4

| Symbol | Decarburization annealing condition | TiN coating through CVD | Magnetic properties $W_{17/50}$ (W/kg) | $B_8$ (T) |
|---|---|---|---|---|
| A | conventional | absence | 0.86 | 1.908 |
| B | method | presence | 0.71 | 1.917 |
| C | invention | absence | 0.83 | 1.978 |
| D | method | presence | 0.68 | 1.979 |

The inventors have aimed at the components and application method of the annealing separator and made various studies.

As a result, it has been found that in order to give a difference of secondary recrystallization starting temperature within a range of 10° C. to 200° C. to the steel sheet as mentioned above, it is very effective to include at least one of S, Se and compounds thereof into the annealing separator and to continuously and/or stepwise form regions having a difference of concentration of S and/or Se of not less than 0.01% when the annealing separator is applied to the steel sheet.

That is, the regions having different concentrations of S and/or Se in the annealing separator are continuously and/or stepwise formed in the widthwise and/or longitudinal direction of the steel sheet to form regions having different secondary recrystallization starting temperatures, whereby secondary recrystallized grains of {110}<001> orientation are preferentially produced from the region having a high concentration of S and/or Se or a low secondary recrystallization starting temperature and grown into big grains due to the coalescing thereof before the formation of secondary recrystallized grain at the region having a low concentration of S and/or Se or a high secondary recrystallization starting temperature, and consequently the secondary recrystallization of the desired orientation can be completed in the widthwise and longitudinal directions. In this case, when the concentration difference of S and/or Se in the annealing separator is not less than 0.01%, the predetermined difference of secondary recrystallization starting temperature is ensured on the surface of the steel sheet.

As the method of giving such a concentration difference, it is preferable that a slurry of an annealing separator mainly composed of MgO is first applied and at least one of S, Se and compounds thereof is continuously and/or stepwise applied in the widthwise and/or longitudinal direction in accordance with the purpose before the drying of the slurry.

When the concentration of S and/or Se is changed stepwise, it is necessary that the concentration difference between the adjoining regions is not less than 0.01% as previously mentioned. On the other hand, when the concentration of S and/or Se is changed continuously, it is preferable that the concentration gradient is not less than 0.005% per unit length of 10 cm.

The above will be described with reference to the following example.

A hot rolled sheet of silicon steel having a composition of C: 0.040%, Si: 3.35%, Mn: 0.070%, Se: 0.020% and Sb: 0.025% and a thickness of 2.2 mm was annealed at 950° C. for 2 minutes, pickled, subjected to a first cold rolling to a thickness of 0.60 mm, subjected to an intermediate annealing at 970° C. for 1.5 minutes, and subjected to a second cold rolling to provide a final sheet gauge of 0.22 mm. After the degreasing, the sheet was subjected to decarburization and primary recrystallization annealing and coated with a slurry of an annealing separator mainly composed of MgO, which was dried, heated at a temperature rising rate of 2.5° C./hr over a range of 820°~925° C. and subjected to purification annealing at 1,200° C. in a dry hydrogen atmosphere for 10 hours. After the oxide film was removed by pickling, the sheet was subjected to a chemical polishing with a mixed solution of 3% HF and $H_2O_2$ to render the surface into a mirror state, and then TiN coating of 0.8 μm was formed on the sheet surface by treating in a gas atmosphere of $TiCl_4$ (70%) through CVD process.

At the above application step of the annealing separator, immediately after the application of the separator mainly composed of MgO, iron sulfide was applied stepwise to the sheet in the widthwise direction thereof so that the concentration of S was 0% at a region corresponding to ¼ from one end of the sheet in the widthwise direction, 0.75% at a region corresponding to 2/4 in the widthwise direction, 1.5% at a region corresponding to ¾ in the widthwise direction and 2.25% at the other remaining end region, and then rapidly dried.

When the secondary recrystallization starting temperature was measured after the temperature holding for 20 hours, it was 903° C. at the ¼ region, 888° C. at the 2/4 region, 873° C. at the ¾ region and 858° C. at the other end region.

The magnetic properties $B_8$ (T) and $W_{17/50}$ (W/kg) of the thus obtained grain oriented silicon steel sheet were measured to obtain results as described below.

For the comparison, the measured results with respect to the sheet product manufactured at the usual steps without the application of iron sulfide are also shown.

| | $B_8$ (T) | $W_{17/50}$ (W/kg) |
|---|---|---|
| Acceptable Example | 1.969 | 0.62 |
| Comparative Example | 1.897 | 0.90 |

As seen from the above, the products highly aligned into {110}<001> orientation are obtained by continuously or stepwise changing the secondary recrystallization starting temperature in the widthwise and/or longitudinal direction of the steel sheet prior to the secondary recrystallization annealing. In this method, the sheet may be subjected to a temperature gradient annealing in the secondary recrystallization, if necessary.

In case of combining with the temperature gradient annealing, it is possible to grow grains of {110}<001> orientation from the region having a high secondary recrystallization starting temperature to the region having a low secondary recrystallization starting temperature by utilizing the difference of the secondary recrystallization starting temperature inherent to the steel sheet.

Moreover, the growth from the region having a low secondary recrystallization starting temperature to the region having a high secondary recrystallization starting temperature is made possible by changing the secondary recrystallization starting temperature in the steel sheet without using the temperature gradient annealing. In this case, the temperature gradient annealing is substantially the same as in the case that the difference of the secondary recrystallization starting temperature is made larger in the steel sheet. On the other hand, the feature that the difference of the secondary recrystallization starting temperature is given to the steel sheet has a merit that the grain growth is made easier as compared with the conventional temeprature gradient annealing.

On the contrary, the grain growth from the region having a high secondary recrystallization starting temperature toward the region having a low secondary recrystallization starting temperature has a great effect of improving the magnetic properties. This will be described in detail below.

As previously mentioned, Japanese Patent Application Publication No. 58-50,295 discloses a method of obtaining a high magnetic flux density by giving a unidirectional temperature gradient to the steel sheet in the secondary recrystallization to selectively grow secondary recrystallized grains of {110}<001> orientation. This method utilizes a phenomenon inherent to the secondary recrystallization that the rate of nucleus formation of secondary recrystallized grain is relatively high at a high temperature, while the rate of grain growth is high at a low temperature, and is to improve the directionality of the steel sheet as a whole by heating the resulting secondary recrystallized grains while giving the temperature gradient to grow into big grains.

In the above conventional method, however, no means is applied to the first produced secondary grain, so that the magnetic properties of the steel sheet itself are largely influenced by the orientation of the first produced secondary grain. In other words, these magnetic properties are largely dependent upon the accidence. Therefore, this method has a problem that the high magnetic flux density is not necessarily obtained.

The invention is to advantageously solve the above problem and to provide a method wherein grain oriented silicon steel sheets having an orientation of secondary recrystallized grain highly aligned into Goss orientation and hence a high magnetic flux density by first producing grain nucleus of {110}<001> or Goss orientation with a high probability and then preferentially growing secondary grains of this orientation.

With the foregoing in mind, the inventors have made further studies with respect to the nucleus formation and grain growth.

As a result, it has been confirmed that the secondary recrystallized grains produced by the nucleus formation from a region having a strong inhibition force are generally excellent in the directionality of {110}<001> orientation and that since the secondary recrystallization starting temperature ($T_{SR}$) becomes high at the region having such a strong inhibition force, if it is subjected to an ordinary annealing, the primary recrystallization structure is coalesced by the grain growth of crystal grains having a bad directionality produced from a region having a low $T_{SR}$ and consequently it is difficult to expect the nucleus formation of secondary grain having a good directionality of {110}<001> orientation.

On the other hand, it has been confirmed that when the grain growth is performed by intentionally changing the structure inside the steel sheet or the inhibition force through the inhibitor to give the temperature gradient larger than $T_{SR}$ from the region having a strong inhibition force and a high $T_{SR}$ toward the region having a weak inhibition force and a low $T_{SR}$, secondary recrystallized grains having a good directionality of {110}<001> orientation are stably grown and obtained through the nucleus formation at the region having high $T_{SR}$.

The invention is based on the above knowledge.

That is, the invention provides a method of producing a grain oriented silicon steel sheet having excellent magnetic properties by a series of steps of hot rolling a slab of silicon containing steel, cold rolling it to a given final sheet gauge, and subjecting to decarburization and primary recrystallization annealing, secondary recrystallization annealing and further purification annealing, characterized in that an annealing temperature before the cold rolling is continuously and/or stepwise changed in the longitudinal and/or widthwise direction of the steel sheet to give a local difference of not lower than 10° C. to subsequent secondary recrystallization starting temperature of the steel sheet, and thereafter temperature gradient annealing wherein secondary recrystallization is started from a region having a high secondary recrystallization starting temperature is performed at a temperature gradient larger than the difference of the secondary recrystallization starting temperature.

This method will be described with reference to an example that the carbon content is continuously and/or stepwise changed within a range of 0.002~0.05% in the widthwise and/or longitudinal direction of the steel sheet at a stage before the decarburization and primary recrystallization annealing to give the local difference of not lower than 10° C. to the secondary recrystallization starting temperature of the steel sheet.

If there is a difference in the C content, there is caused a difference in the form and amount of precipitated C and solute C, which affects the strain state in the cold rolling, recrystallization temperature, texture, crystal structure and the like, so that the change of C content can be utilized to control $T_{SR}$.

A slab of silicon steel having a composition of C: 0.054%, Si: 3.42%, Mn: 0.071%, P: 0.01%, S: 0.006%, Al: 0.001%, Se: 0.021%, Sb: 0.027% and Mo: 0.021% was hot rolled to a thickness of 2 mm, which was subjected to a two-time cold rolling through an intermediate annealing to provide a given final sheet gauge, during which an experiment of varying the decarburization amount in the intermediate annealing and an experiment of varying the second cold rolling reduction were made. Thereafter, the cold rolled sheet was subjected to decarburization annealing up to C≦0.002%, coated with a slurry of an annealing separator mainly composed of MgO, and then $T_{SR}$ was measured. The results are shown in FIG. 6.

Figure 6:
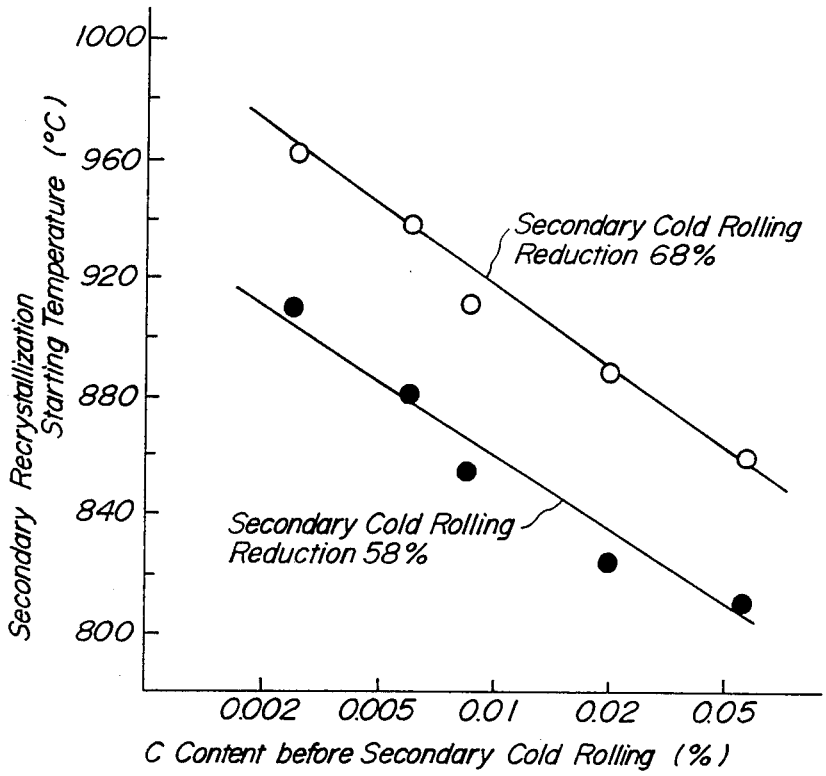
FIG. 6 is a graph showing a relation between a carbon amount before decarburization and primary recrystallization annealing and a secondary recrystallization starting temperature using a secondary cold rolling reduction as a parameter.

As seen from FIG. 6, it is possible to change $T_{SR}$ by varying the C content. Furthermore, the similar effect is obtained even when the decarburization is carried out in the annealing of the hot rolled sheet instead of the intermediate annealing. Moreover, $T_{SR}$ can largely be changed by combining with the cold rolling reduction, the cooling rate in the annealing and the like.

Now, the first cold rolled sheet of 1 m in width was subjected to an iron plating by changing the plated thickness within a range of 0.2~5 μm in the widthwise direction of the sheet and further to an intermediate decarburization annealing at 950° C. in a wet hydrogen atmosphere (dew point: 30° C.) for 3 minutes. In this case, the iron plated thickness was controlled by arranging a metal mesh between the sheet and the cell in a usual electroplating line to control a current density in the widthwise direction of the sheet. As disclosed in Japanese Patent Application Publication No. 59-10,412, the internal oxide layer of Si is restrained by subjecting to such an iron plating, whereby the decarburization is not obstructed and there is caused the difference in the decarburization amount in accordance with the thickness of the iron plated layer. Further, this effect can be more enhanced by applying a decarburization accelerating agent or delaying agent. Moreover, the technique of utilizing such a decarburization accelerating or delaying agent is disclosed, for example, in Japanese Patent laid open No. 60-39,124, but this technique is to improve the primary recrystallization structure by forming the difference of decarburization rate at the decarburization annealing in the steel sheet, so that the conventional technique has an influence upon the frequency of nucleus formation in the recrystallization course of the decarburization annealing and the grain growth, but is not effective to positively change $T_{SR}$.

Then, the sheet was subjected to a second cold rolling to provide a final sheet gauge, completely decarburized by annealing at 850° C. in a wet hydrogen atmosphere (dew point: 55° C.) for 2 minutes, coated with a slurry of an annealing separator mainly composed of MgO, subjected to secondary recrystallization by heating over a range of 800°~1,000° C. at a temperature rising rate of 5° C./hr and further to purification annealing in a dry hydrogen atmosphere at 1,200° C. for 10 hours.

Figure 7:
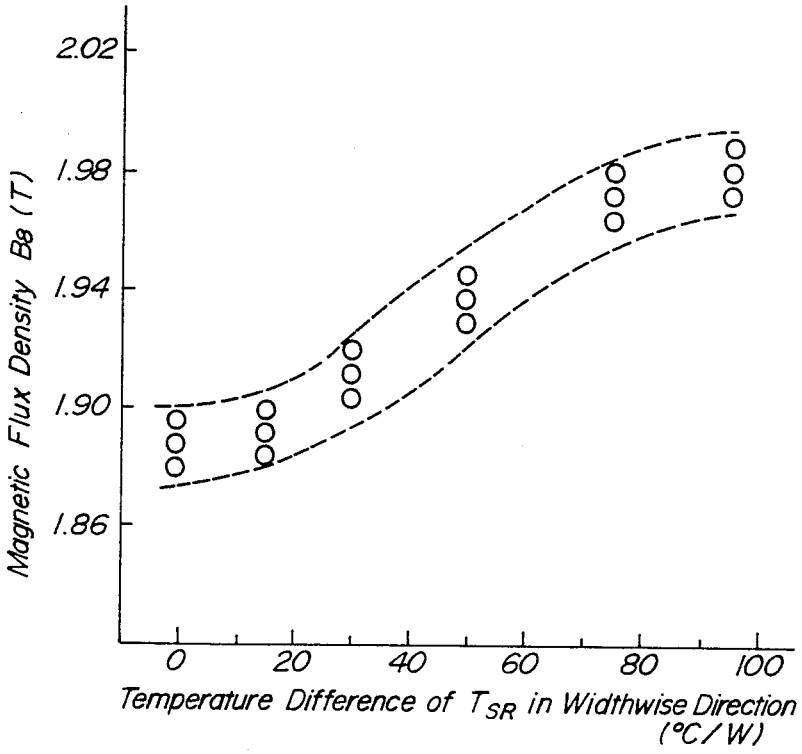
FIG. 7 is a graph showing a relation between a temperature difference of secondary recrystallization temperature in widthwise direction and a magnetic flux density $B_8$.

The magnetic properties of the thus obtained sheet product were measured to obtain results shown in FIG. 7 as a relation to temperature difference of $T_{SR}$ in the widthwise direction.

As seen from FIG. 7, the magnetic flux density is improved by providing the difference of C content before the decarburization annealing, and particularly good results are obtained when the temperature difference as $T_{SR}$ is not less than 30° C./m.

According to the invention, it is important that the C content is continuously and/or stepwise changed within a range of 0.002~0.05% in the normalized annealing and/or intermediate annealing and further the heat treatment after the cold rolling and before the recrystallization annealing. The reason why the variable range of the C content is limited to 0.002~0.05% is due to the fact that when the C content is less than 0.002%, a long time is taken for the decarburization in the middle of the usual decarburization annealing to impede the productivity, while since decarburization of C≦0.002% is performed in the decarburization annealing, the upper limit is about 0.05% up to this stage.

In order to obtain the effect aiming at by the invention, it is necessary that a region having a temperature difference of secondary recrystallization starting temperature of not lower than 10° C. is formed in the steel sheet. For this purpose, it is required that the difference of the C content is not less than 2 times when continuously or stepwise changing the C content.

Then, the sheet was annealed at 700°~900° C. in a wet hydrogen atmosphere for about 1~15 minutes, whereby C in steel was removed and also the primary recrystallization structure useful for achieving secondary recrystallized grains of Goss orientation in the subsequent annealing was formed.

After the application of the annealing separator, the sheet was coiled, which was subjected to secondary recrystallization annealing. In this case, the secondary recrystallization annealing was particularly and advantageously carried out by heating at a temperature rising rate of not more than 10° C./hr from a minimum temperature starting the secondary recrystallization to a temperature completing the secondary recrystallization (usually 800°~1,000° C.), or by uniformly holding the temperature at a minimum temperature region starting the secondary recrystallization till the secondary recrystallization was completed. The reason why the temperature rising rate is limited to not more than 10° C./hr is due to the fact that when the temperature rising rate exceeds 10° C./hr, the formation and growth of the secondary recrystallized grains are rapidly caused to undesirably obstruct the selective growth of {110}<001> orientation.

Then, the temperature gradient annealing starting the secondary recrystallization from an end portion of the steel sheet with a high $T_{SR}$ was performed at the temperature gradient larger than the gradient of $T_{SR}$ as previously mentioned. In this temperature gradient annealing, the temperature gradient is desirable to be not lower than 2° C. per unit length of 1 cm.

Thereafter, the sheet was subjected to purification annealing in a dry hydrogen atmosphere at 1,100°~1,250° C. for about 5~25 hours.

As such a final annealing, the type of annealing the coiled sheet is practised in industry, but a continuous type of continuously annealing a single sheet (inclusive of cut sheet) or a laminate of these sheets is proposed. In the invention, both types may be used.

Furthermore, the temperature gradient can easily be achieved by arranging a zone having a temperature gradient inside the annealing furnace. The direction of the temperature gradient may be widthwise or longitudinal direction of the steel sheet or any other direction.

Although the magnetic properties can effectively be improved by a series of such treatments according to the invention, they can be more improved by forming a tension-applied type extremely thin coating on the steel sheet surface through a technique for magnetic domain refinement such as laser irradiation after the purification annealing.

In general, it is considered that decarburization regions are locally formed at a preliminary step of decarburization annealing after the final cold rolling in order to partially change the C content in the steel sheet, which can be realized by locally forming a plated layer of Fe, Ni, Cu or the like at each stage of coiling after the hot rolling, normalized annealing of hot rolled sheet, intermediate annealing and the like. In this case, the decarburization accelerating or delaying agent may be used. As the decarburization accelerating and delaying agents, mention may be made of the following solutions:

Decarburization accelerating agent: $MgCl_2.6H_2O$, $Mg(NO_3)_2.6H_2O$, $CaCl_2.2H_2O$, $Ca(NO_3)_2.4H_2O$, $SrCl_2.2H_2O$, $Sr(NO_3)_2.4H_2O$, $BaCl_2.2H_2O$, $Ba(NO_3)_2$, KCl, $KMnO_4$, $K_2P_2O_7$, KBr, $KClO_3$, $KBrO_3$, KF, NaCl, $NaIO_4$, NaOH, $NaHPO_4$, $NaH_2PO_4.2H_2O$, NaF, $NaHCO_3$, $Ta_2O_5$, $Na_4P_2O_7.10H_2O$, NaI, $(NH_4)_2Cr_2O_7$, $Cu(NO_3)_2.3H_2O$, $Fe(NO_3)_3.9H_2O$, $Co(NO_3)_2.6H_2O$, $Na(NO_3)_2.9H_2O$, $Pd(NO_3)_2$, $Zn(NO_3)_2.6H_2O$ and so on.

Decarburization delaying agent: $K_2S$, $Na_2S_2O_2.5H_2O$, $Na_2S.9H_2O$, $MgSO_4$, $SrSO_4$, $Al_2(SO_4)_3.18H_2O$, $S_2Cl_2$, $NaHSO_3$, $FeSO_4.7H_2O$, $KHSO_4$, $Na_2S_2O_8$, $K_2S_2O_7$, $Ti(SO_4)_2.3H_2O$, $CuSO_4.5H_2O$, $ZnSO_4.7H_2O$, $CrSO_4.7H_2O$, $(NH_4)_2S_2O_8$, $H_2SO_4$, $H_2SeO_3$, $SeOCl_2$, $Se_2Cl_2$, $SeO_2$, $H_2SeO_4$, $K_2Se$, $Na_2Se$, $Na_2SeO_3$, $K_2SeO_3$, $H_2TeO_4.2H_2O$, $Na_2TeO_3$, $K_2TeO_4.3H_2O$, $TeCl_4$, $Na_2TeO_4$, $Na_2AsO_2$, $H_2AsO_4$, $AsCl_3$, $(NH_4)_3AsO_4$, $KH_2AsO_4$, SbOCl, $SbCl_3$, $SbBr_3$, $Sb(SO_4)_3$, $Sb_2O_3$, $BiCl_3$, $Bi(OH)_3$, $BiF_3$, $NaBiO_3$, $Bi_2(SO_4)_3$, $SnCl_2.2H_2O$, $PbCl_2$, $PbO(OH)_2$, $Pb(NO_3)_2$ and so on.

By properly using these solutions, the decarburization amount can locally be controlled in the steel sheet. The change of the C content varies with the introduction of these solutions and the degree of crystal rotation. Furthermore, there are caused differences in the rate of nucleus formation and recrystallization temperature at the annealing. As a result, the local difference is caused in the primary recrystallization structure and crystal grain size after the final decarburization annealing and hence these local differences affect $T_{SR}$.

In the subsequent secondary recrystallization annealing, therefore, secondary recrystallized grains of {110}<001> orientation are preferentially produced from the region having a low secondary recrystallization starting temperature, while the primary recrystallized grains are coalesced by the secondary recrystallized grain of {110}<001> orientation at the region having a high secondary recrystallization starting temperature before the formation of secondary recrystallized grain at the latter region, so that the texture highly aligned into {110}<001> orientation is finally formed and hence the high magnetic flux density is obtained.

In the method of performing the temperature gradient annealing, when the steel sheet is heated from the region having a high $T_{SR}$ while giving the temperature gradient larger than the gradient of $T_{SR}$, the end portion of the steel sheet first rises to a temperature above $T_{SR}$ and a small amount of grain nucleus having a good directionality is produced to form a secondary recrystallization region. Between the secondary recrystallization region and the region not reaching to $T_{SR}$ is produced a mixed region of the primary recrystallization structure and the secondary recrystallization structure at a narrow range. As the temperature of the steel sheet rises, the mixed region moves toward low temperature side and consequently the secondary recrystallization region becomes enlarged to cause the grain growth.

As mentioned above, the grain growth in the secondary recrystallization occurs at a temperature lower than the nucleus formation temperature, so that when the temperature rises while giving the temperature gradient, there is caused no new nucleus formation in the course of the temperature rising as far as the temperature rising rate is not excessive, and the first oriented crystal grains grow toward the low temperature side. During the growth, the temperature at the boundary region between primary recrystallization and secondary recrystallization is maintained at a relatively constant level.

The inventors have confirmed from experiments that the considerable effect in the improvement of $B_8$ is observed when the temperature difference of $T_{SR}$ between the position of first nucleus formation for secondary recrystallized grain and the delayed portion is not lower than 10° C. and the temperature gradient is not less than 2° C./cm.

When the secondary recrystallization is progressed while giving the temperature gradient, the temperature causing the secondary recrystallization is not constant depending upon the kind of the steel sheet and the temperature rising conditions, so that the temperature range thereof can not be restricted, but it is within a range of 800°~1,000° C. in case of grain oriented silicon steel sheets. According to the invention, it is sufficient to set the temperature gradient in such a boundary region, so that the conventionally used treating conditions may be adopted before and after the boundary region and the temperature gradient may naturally be applied thereof.

Thus, grain oriented silicon steel sheets having excellent magnetic properties, particularly magnetic flux density can stably be obtained.

The temperature gradient in the temperature gradient annealing will be described in detail with reference to the following example.

A slab of silicon steel having a composition of C: 0.052%, Si: 3.00%, Mn: 0.082%, S: 0.026%, Al: 0.028% and N: 0.0079% was heated to 1,400° C. and hot rolled to a thickness of 2.3 mm. Then, the hot rolled sheet was annealed and subjected to a final cold rolling, wherein the steel sheet was divided into two specimens and one of these specimens was rolled with a roll having a surface roughness continuously changed from one end portion of Ra=0.1 μm in the longitudinal direction of the roll drum to the other end portion of Ra=2.0 μm and then with a roll having a surface roughness of 0.1 μm at only a final rolling pass, while the other specimen was rolled with a roll having a uniform surface roughness of 0.5 μm.

These cold rolled sheets were subjected to decarburization and primary recrystallization annealing in a wet hydrogen atmosphere at 850° C. for 3 minutes. In this case, $T_{SR}$ was measured to be 990° C. at the region having a roll roughness of 0.1 μm, 970° C. at the region having a roll roughness of 0.5 μm and 950° C. at the region having a roll roughness of 2.0 μm.

After the application of a slurry of an annealing separator mainly composed of MgO, these steel sheets where subjected to a final annealing, wherein the temperature was raised from room temperature to 950° C. at a rate of 50° C./hr and from 950° C. to 1,200° C. at a rate of 20° C./hr in an atmosphere of 25 vol % $N_2$-75 vol % $H_2$. In this case, the temperature gradient of 0° C./cm, 1° C./cm, 2° C./cm and 5° C./cm was given to the portion of the sheet having a temperature range of 950°~1,100° C., provided that the end portion of the sheet rolled at Ra=2.0 μm was positioned in a high temperature side.

The temperature gradient was given by using an annealing furnace of 1 m in length, wherein the heating region was divided into five zones and the temperature in each zone was controlled separately. Then, the sheet was subjected to purification annealing in $H_2$ at 1,200° C. for 20 hours.

Figure 8:
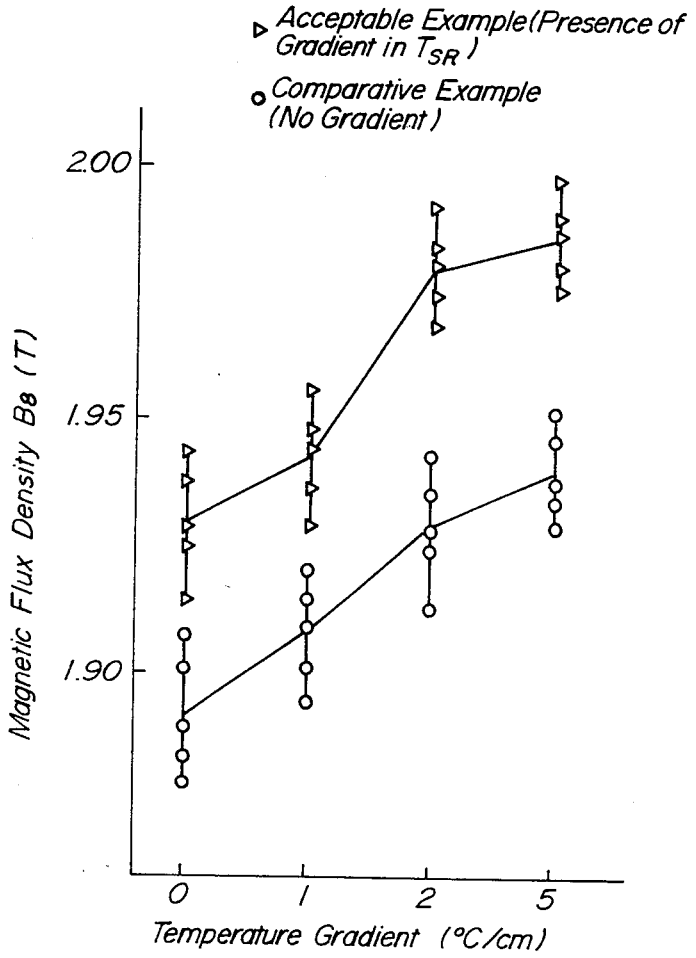
FIGS. 8 and 9 are graphs showing a relation between a temperature gradient in final annealing and a magnetic flux density $B_8$.

The $B_8$ characteristics of the thus obtained products are shown in FIG. 8.

As seen from FIG. 8, the $B_8$ characteristic is improved by the finish annealing having the temperature gradient, and particularly the $B_8$ characteristic is considerably improved when the sheet having a gradient of $T_{SR}$ is subjected to a final annealing at a temperature gradient of not less than 2° C./cm.

Figure 9:
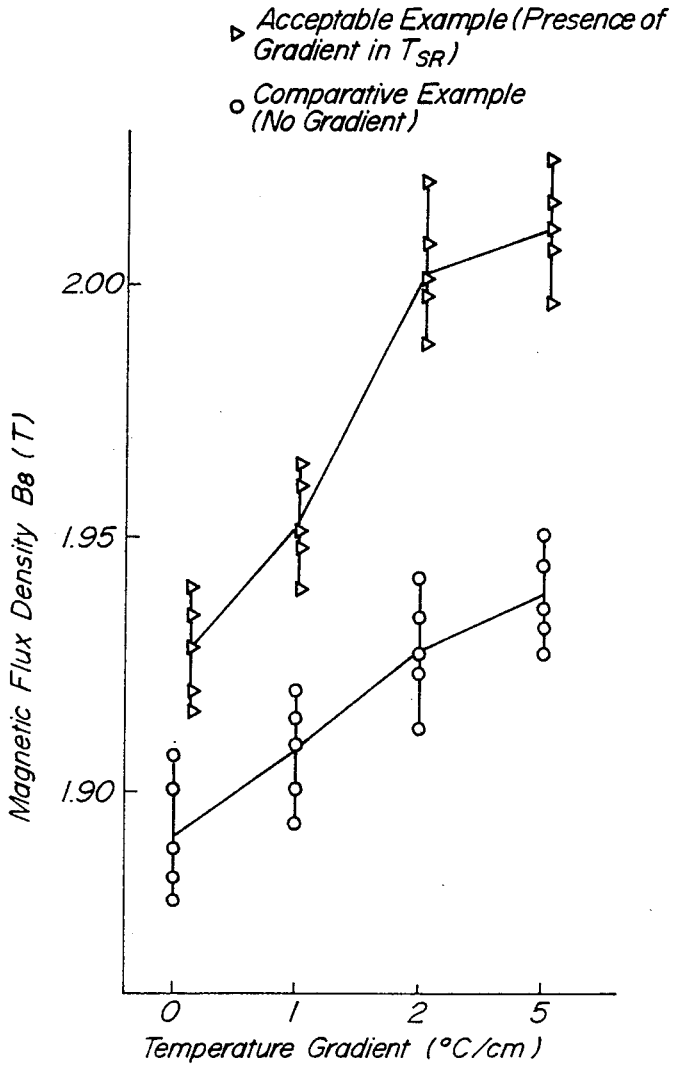

This is a method of starting the secondary recrystallization from the end portion having a low $T_{SR}$. On the other hand, it is possible to start the secondary recrystallization from the end portion having a high $T_{SR}$ by the combination of a method of giving the difference of $T_{SR}$ to the steel sheet and a temperature gradient annealing as previously mentioned. Moreover, FIG. 9 shows results when the above sheet was rolled so as to render the roll roughness into 0.1 μm at the end of the sheet and 2 μm at the center of the sheet and then subjected to secondary recrystallization in the same manner as described above. As seen from FIG. 9, the improving effect of the magnetic flux density is also obtained by the latter method.

The following examples are given in illustration of the invention and are not intended to limitations thereof.

EXAMPLE 1

A slab of silicon steel containing C: 0.042%, Si: 3.35%, Mn: 0.07%, Se: 0.020% and Sb: 0.025% was soaked in a heating furnace at 1,400° C. and then hot rolled to a thickness of 2.2 mm. The hot rolled sheet was subjected to a two-time cold rolling through an intermediate annealing with a dull roll having a roughness continuously changed from Ra=2.0 μm at both ends in the longitudinal direction of roll drum to 0.05 μm at the central portion thereof to thereby obtain a cold rolled sheet having a final gauge of 0.22 mm. In this case, the final rolling pass at the second cold rolling was carried out by using a bright roll of Ra=0.05 μ. Then, the cold rolled sheet was subjected to decarburization and primary recrystallization annealing in a wet hydrogen atmosphere at 850° C. for 3 minutes and coated with a slurry of an annealing separator mainly composed of MgO. Moreover, $T_{SR}$ was measured to be continuously changed from 820° C. in the roll roughness of 2.0 μm to 880° C. in Ra=0.05 μm. Thereafter, the sheet was subjected to a finish annealing in $N_2$ atmosphere, wherein the temperature was raised from room temperature to 800° C. at a rate of 50° C./hr and from 800° C. to 1,000° C. at a rate of 1°~50° C./hr, during which the temperature was held at 870° C. for 100 hours. Then, the sheet was subjected to purification annealing at 1,200° C. for 10 hours.

The magnetic properties of the thus obtained sheet products are shown in the following Table 5.

As seen from Table 5, the $B_8$ characteristic is considerably improved by giving the difference of $T_{SR}$ to the steel sheet and further controlling the temperature rising rate in the secondary recrystallization annealing.

TABLE 5

| No. | Heating rate | Magnetic properties $W_{17/50}$ | $B_8$ | Remarks |
|---|---|---|---|---|
| 1 | 1° C./h | 0.840 | 1.936 | Acceptable Example |
| 2 | 2° C./h | 0.845 | 1.932 | Acceptable Example |
| 3 | 5° C./h | 0.842 | 1.930 | Acceptable Example |
| 4 | 10° C./h | 0.851 | 1.926 | Acceptable Example |
| 5 | 20° C./h | 0.896 | 1.892 | Comparative Example |
| 6 | 50° C./h | 0.910 | 1.880 | Comparative Example |
| 7 | 820° C., 100 h | 0.830 | 1.935 | Acceptable Example |

EXAMPLE 2

Figure 10:
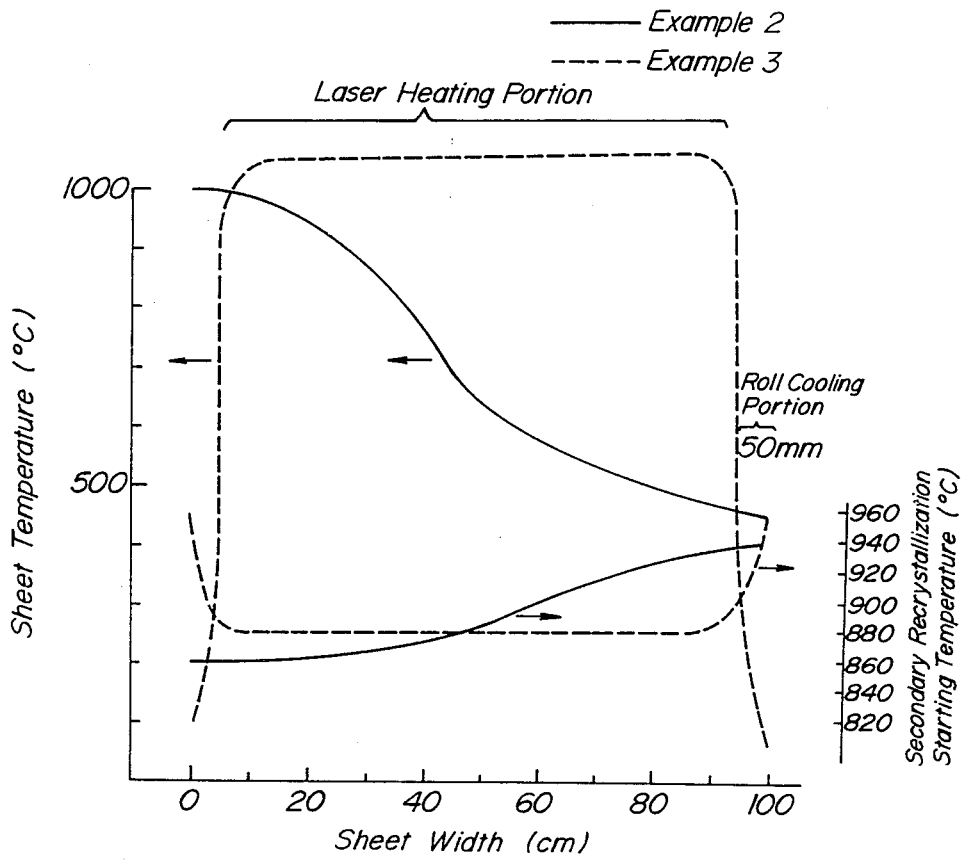
FIG. 10 is a graph showing a temperature distribution of steel sheet in an intermediate annealing and a distribution of secondary recrystallization starting temperature in Examples 2 and 3.

A hot rolled sheet of silicon steel having a composition of C: 0.047%, Si: 3.41%, Mn: 0.072%, Se: 0.027%, Sb: 0.025% and the balance being substantially Fe was annealed, descaled, subjected to a first cold rolling and divided into four specimens A~D. Among these specimens, the specimens A and B were subjected to an intermediate annealing at 1,000° C. in a continuous annealing furnace provided with rolls partially cooled in the widthwise direction of the sheet while giving the temperature difference to the sheet as shown in FIG. 10, wherein the secondary recrystallization starting temperature was 940° C. at high temperature side and 860° C. at low temperature side. On the other hand, the specimens C and D were subjected to an intermediate annealing at 1,000° C. uniformly in the widthwise direction thereof, wherein the secondary recrystallization starting temperature was 860° C.

These specimens were subjected to a second cold rolling to provide a final sheet gauge of 0.23 mm. Thereafter, they were subjected to decarburization and primary recrystallization annealing at 830° C. for 2 minutes, coated with a slurry of an annealing separator and annealed in form of a coil. In the coil annealing, the specimens A and B were held for 40 hours at 940° C. in high temperature side and at 840° C. in low temperature side by means of a coil annealing furnace provided at its end with a heating element and a cooling element so as to start the secondary recrystallization temperature from 940° C., heated at a temperature rising rate of 2° C./hr with the holding of such a temperature gradient for 20 hours to complete the secondary recrystallization, and subjected to purification annealing at 1,200° C. for 10 hours. On the other hand, the specimens C and D were held at 860° C. for 70 hours to complete secondary recrystallization, and then subjected to purification annealing at 1,200° C. for 10 hours.

Moreover, the specimens B and D were subjected to magnetic domain refinement by irradiating a laser with an energy density of 20 J/cm$^2$ at a pitch of 7 mm in a direction perpendicular to the rolling direction of the sheet.

The magnetic properties of the thus obtained sheet products were measured to obtain results shown in the following Table 6.

Moreover, the magnetic properties were substantially the same in the widthwise direction.

TABLE 6

| Symbol | Intermediate annealing condition | Magnetic domain refinement through laser | Magnetic properties $W_{17/50}$ (W/kg) | $B_8$ (T) |
|---|---|---|---|---|
| A | invention | absence | 0.80 | 1.989 |
| B | method | presence | 0.65 | 1.985 |
| C | conventional | absence | 0.89 | 1.893 |
| D | method | presence | 0.84 | 1.887 |

EXAMPLE 3

A hot rolled sheet of silicon steel having a composition of C: 0.055%, Si: 3.27%, Mn: 0.082%, S: 0.027%, Al: 0.032%, N: 0.0079% and the balance being substantially Fe was annealed, subjected to a first cold rolling and divided into four specimens A~D. Then, these specimens were subjected to an intermediate annealing, wherein the specimens A and B were annealed in a continuous annealing furnace capable of laser heating a central portion of 900 mm in the sheet of 1,000 mm in width so as to have a sheet temperature distribution of 1,050° C. at the central portion and not higher than 500° C. at both end portions as shown in FIG. 2. In this case, the secondary recrystallization starting temperature in the widthwise direction of the sheet was 880° C. at the central portion and 960° C. at both end portions. On the other hand, the specimens C and D were uniformly subjected to an intermediate annealing at 1,050° C., wherein the secondary recrystallization starting temperature was 880° C.

Then, these specimens were subjected to a second cold rolling to provide a final sheet gauge of 0.23 mm, which were subjected to decarburization and primary recrystallization annealing at 825° C. for 2.5 minutes, coated with a slurry of an annealing separator, and then annealed in form of coil. The coil annealing was carried out in a coil annealing furnace provided with a heater capable of heating both side end surfaces of the coil so as to heat both side end portions of the coil to 960° C. and the central portion at 870° C. After the temperature was raised at a rate of 10° C./hr with the holding of such a temperature gradient for 20 hours, they were subjected to a purification annealing at 1,200° C. for 15 hours.

Moreover, the specimens B and D were subjected to chemical polishing with a mixed solution of 3% HF and $H_2O_2$ into a mirror state after insulative film was removed by pickling, and then subjected to a heat treatment at 750° C. in a mixed gas atmosphere of $TiCl_4$, $N_2$ and $CH_4$ to form Ti(C,N) layer of 0.5 μm in thickness on the sheet surface through CVD.

The magnetic properties of the thus obtained sheet products were measured to obtain results as shown in the following Table 7.

Moreover, the magnetic properties were substantially the same in the widthwise direction.

TABLE 7

| Symbol | Intermediate annealing condition | Surface treatment through CVD | Magnetic properties $W_{17/50}$ (W/kg) | $B_8$ (T) |
|---|---|---|---|---|
| A | invention | absence | 0.79 | 1.990 |
| B | method | presence | 0.64 | 1.995 |
| C | conventional | absence | 0.88 | 1.900 |
| D | method | presence | 0.83 | 1.904 |

EXAMPLE 4

A slab of silicon steel containing C: 0048%, Si: 3.36%, Mn: 0.07%, Se: 0.022% and Sb: 0.026% was soaked at 1,400° C. in a heating furnace, hot rolled to a thickness of 2.0 mm and subjected to a two-time cold rolling through an intermediate annealing to provide a final sheet gauge of 0.22 mm. In this case, the sheet after the first cold rolling was subjected to an iron plating so as to vary the plated thickness in the widthwise direction to 0.2, 0.5, 1, 2, 2.3 and 5.0 μm and then subjected to an intermediate annealing in a wet hydrogen atmosphere at 950° C. for 3 minutes. After the second cold rolling, the sheet was subjected to decarburization and primary recrystallization annealing, and coated with a slurry of an annealing separator mainly composed of MgO. In this case, $T_{SR}$ was measured to be continuously changed from 840° C. at the plated thickness of 0.2 μm to 940° C. at the plated thickness of 5 μm.

Then, the sheet was subjected to a finish annealing in $N_2$ atmosphere, wherein the temperature was raised from room temperature to 830° C. at a rate of 50° C./hr and from 830° C. to 1,000° C. at a rate of 5° C./hr, and further to purification annealing at 1,200° C. for 10 hours.

The magnetic properties of the thus obtained sheet products were measured to obtain results as shown in the following Table 8.

As seen from Table 8, the $B_8$ characteristic is particularly and considerably improved by giving the difference of $T_{SR}$ to the steel sheet.

TABLE 8

| No. | Thickness of Fe-plated layer (μm) end portion | Thickness of Fe-plated layer (μm) central portion | C content after intermediate annealing (%) end portion | C content after intermediate annealing (%) central portion | $T_{SR}$ (°C.) end portion | $T_{SR}$ (°C.) central portion | Magnetic properties $W_{17/50}$ (W/kg) | Magnetic properties $B_8$ (T) | Remarks |
|---|---|---|---|---|---|---|---|---|---|
| 1 | 0.2 | 5.0 | 0.048 | 0.003 | 840 | 940 | 0.788 | 1.970 | Acceptable Example |
| 2 | 0.2 | 2.3 | 0.048 | 0.007 | 840 | 890 | 0.810 | 1.956 | Acceptable Example |
| 3 | 0.2 | 1.2 | 0.048 | 0.014 | 840 | 875 | 0.839 | 1.942 | Acceptable Example |
| 4 | 0.2 | 0.5 | 0.048 | 0.022 | 840 | 860 | 0.868 | 1.916 | Acceptable Example |
| 5 | 0.2 | 0.2 | 0.048 | 0.048 | 840 | 840 | 0.882 | 1.883 | Comparative Example |

EXAMPLE 5

A slab of silicon steel containing C: 0.056%, Si: 3.09%, Mn: 0.084%, S: 0.026%, Al: 0.025% and N: 0.008% was soaked at 1,400° C. in a heating furnace, hot rolled to a thickness of 2.0 mm and subjected to a heavy cold rolling to provide a final sheet gauge of 0.22 mm. In this case, the hot rolled sheet was pickled, subjected to an iron plating so as to have a plated thickness of 5.0 μm at an end sheet and 0.3 μm at a central portion thereof, subjected to decarburization treatment in a wet hydrogen atmosphere at 850° C. for 5 minutes, subjected to a normalized annealing at 1,150° C. for 1 minute and then quenched. The C content after the normalized annealing was 0.004% at the end portion and 0.055% at the central portion.

After the cold rolling, the sheet was subjected to decarburization and primary recrystallization annealing in a wet hydrogen atmosphere at 850° C. for 3 minutes, and coated with a slurry of an annealing separator. Moreover, $T_{SR}$ was measured to be continuously changed from 1,060° C. at the plated thickness of 5.0 μm to 880° C. at the plated thickness of 0.3 μm.

Then, the sheet was subjected to a finish annealing in an atmosphere of 25%$N_2$-75%$H_2$, wherein the temperature was raised from room temperature to 880° C. at a rate of 50° C./hr and from 880° C. to 1,200° C. at a rate of 20° C./hr, during which a temperature gradient of 5° C./cm was given over a temperature range of 950° C.~1,100° C. so as to locate the decarburized region of the sheet end portion at high temperature side. The temperature gradient was given by using an annealing furnace of 1 m in length, wherein the heating region was divided into five zones and the temperature in each zone was controlled separately. Thereafter, the sheet was subjected to purification annealing at 1,200° C. for 10 hours.

Moreover, the thus obtained sheet product was exposed to a laser beam having an energy density of 20 J/cm$^2$ at a pitch of 10 mm in a direction perpendicular to the rolling direction of the sheet. The magnetic properties before and after the irradiation of the laser beam were measured to obtain results as shown in the following Table 9.

TABLE 9

| No. | Thickness of Fe-plated layer (μm) end portion | Thickness of Fe-plated layer (μm) central portion | $T_{SR}$ (°C.) end portion | $T_{SR}$ (°C.) central portion | Magnetic properties $W_{17/50}$ (W/kg) | Magnetic properties $B_8$ (T) | Magnetic properties after irradiation of laser $W_{17/50}$ (W/kg) | Magnetic properties after irradiation of laser $B_8$ (T) | Remarks |
|---|---|---|---|---|---|---|---|---|---|
| 1 | 5.0 | 0.3 | 1,060 | 880 | 0.806 | 1.988 | 0.709 | 1.986 | Acceptable Example |
| 2 | 0.2 | 0.2 | 880 | 880 | 0.879 | 1.906 | 0.802 | 1.900 | Comparative Example |

EXAMPLE 6

A hot rolled sheet of silicon steel having a composition of C: 0.045%, Si: 3.40%, Mn: 0.065%, Se: 0.022%, Sb: 0.025%, Mo: 0.011% and the balance being substantially Fe was annealed, descaled, subjected to a two-time cold rolling through an intermediate annealing to provide a final sheet gauge of 0.23 mm, and divided into four specimens A~D.

The specimens A and B were subjected to decarburization and primary recrystallization annealing for 2 minutes in a continuous annealing apparatus dividing a heater in the widthwise direction of the coil and provided with a cooling element so as to suppress the temperature rising at the end portion of the coil, wherein the temperature of the coil having a width of 1,000 mm was raised at a rate of 7° C./sec in an end portion of the coil having a width of 30 mm and at a rate of 23° C./sec in the other end portion.

Figure 11:
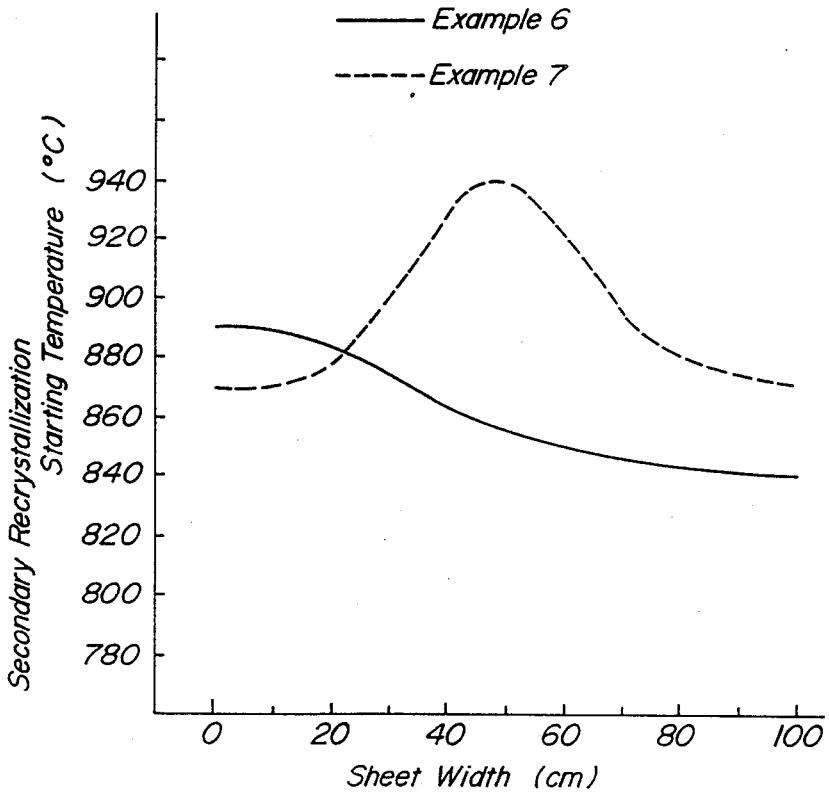
FIG. 11 is a graph showing a distribution of secondary recrystallization starting temperature in widthwise direction of steel sheet in Examples 6 and 7.

On the other hand, the specimens C and D were subjected to decarburization and primary recrystallization annealing by uniformly raising the temperature of the coil at a rate of 22° C./sec over the widthwise direction of the coil Moreover, the secondary recrystallization starting temperature was 890° C. at the end portion of specimens A and B, heated at a rate of 7° C./sec, and 840° C. at the other end portion for specimens A and B and in the specimens C and D. The distribution of the secondary recrystallization starting temperature of this example in the widthwise direction is shown in FIG. 11 by a solid line.

After the application of the slurry of an annealing separator, these specimens were heated in a box type annealing furnace provided with a heater element and a cooling element facing the end surface of the coil by raising the temperature so as to be 890° C. at a side of high secondary recrystallization starting temperature and 800° C. at the opposite side, held at these temperatures for 30 hours, heated by raising the temperature at a rate of 5° C./hr with the holding of such a temperature gradient for 10 hours, and thereafter subjected to purification annealing at 1,200° C. for 10 hours.

Moreover, the specimens B and D after the removal of insulative film were subjected to a chemical polishing with a mixed solution of 3% HF and $H_2O_2$ to render the surface into a mirror state, and subjected to a heat treatment in a mixed gas atmosphere of $CH_4$, $N_2$ and TiCl4 to form Ti(C,N) layer of 0.5 $\mu$m in thickness on the steel sheet surface through CVD.

The magnetic properties of the thus obtained sheet products were measured to obtain results as shown in the following Table 10.

Moreover, all of the magnetic properties were the same in the widthwise direction.

TABLE 10

| Symbol | Decarburization annealing condition | Surface treatment through CVD | Magnetic properties $W_{17/50}$ (W/kg) | $B_8$ (T) |
|---|---|---|---|---|
| A | invention | absence | 0.78 | 1.995 |
| B | method | presence | 0.65 | 1.998 |
| C | conventional | absence | 0.89 | 1.889 |
| D | method | presence | 0.82 | 1.895 |

EXAMPLE 7

A hot rolled sheet of silicon steel having a composition of C: 0.056%, Si: 3.30%, Mn: 0.079%, Se: 0.025%, Al: 0.031%, N: 0.0081% and the balance being substantially Fe was annealed, cold rolled to a final gauge of 0.23 mm and divided into four specimens A~D.

The specimens A and B were subjected to decarburization annealing, wherein the coil of 1,000 mm in width was held at 600° C. in only a region of 40 mm in width at the central portion of the coil in a furnace provided at a front stage with a local heating zone through an infrared ray heater for 30 seconds and then heated to 835° C. at a rate of 19° C./sec in the usual heating zone.

On the other hand, the specimens C and D were subjected to decarburization and primary recrystallization annealing by uniformly heating to 835° C. at a rate of 19° C./sec over the widthwise direction thereof.

In this case, the secondary recrystallization starting temperature was 940° C. at the central portion of the coil and 870° C. at the other portions and in the specimens C and D. The distribution of the secondary recrystallization starting temperature in the specimens A and B is shown in FIG. 11 by dotted lines.

After the application of the slurry of an annealing separator, these specimens were heated at a rate of 8° C./hr so as to have a temperature gradient of 100° C. between the central portion of the coil and the side end portion thereof over a range of 800°~1,000° C. in a coil box annealing furnace provided at it both end portions with a cooling element, and then subjected to purification annealing at 1,200° C. for 13 hours.

Moreover, the specimens B and D were subjected to magnetic domain refinement by irradiating a laser with an energy density of 21 J/cm$^2$ at a pitch of 9 cm in a direction perpendicular to the rolling direction.

The magnetic properties of the thus obtained sheet products were measured to obtain results as shown in the following Table 11.

Moreover, all of the magnetic properties were substantially the same in the widthwise direction.

TABLE 11

| Symbol | Intermediate annealing condition | Laser treatment | Magnetic properties $W_{17/50}$ (W/kg) | $B_8$ (T) |
|---|---|---|---|---|
| A | invention | absence | 0.79 | 1.995 |
| B | method | presence | 0.63 | 1.990 |
| C | conventional | absence | 0.88 | 1.906 |
| D | method | presence | 0.82 | 1.898 |

EXAMPLE 8

A hot rolled sheet of silicon steel containing C: 0.046%, Si: 3.43%, Mn: 0.082%, S: 0.018%, Se: 0.026%, Sb: 0.018% and Sn: 0.035% and having a thickness of 2.7 mm was annealed at 935° C. for 2 minutes, pickled, subjected to a first cold rolling to a thickness of 0.75 mm and an intermediate annealing at 950° C. for 2 minutes, finally cold rolled to a final gauge of 0.30 mm, degreased, subjected to decarburization and primary recrystallization annealing in a wet hydrogen atmosphere, coated with a slurry of an annealing separator mainly composed of MgO, dried, held at 849° C. for 40 hours, heated by raising the temperature at a rate of 7.5° C./hr to 900° C., and subjected to purification annealing in a dry hydrogen atmosphere at 1,200° C. for 10 hours.

In the annealing separator application step, immediately after the application of the separator mainly composed of MgO, a mixture of iron sulfide and anhydrous selenic acid was stepwise applied to the sheet so that the amount of S+Se applied to the sheet of 800 mm in width was 1.6% at both side end portions each having a width of 100 mm, 0.45% at $\frac{1}{4}$ and $\frac{3}{4}$ portions in widthwise direction each having a width of 200 mm and 0% at the central portion having a width of 200 mm, and immediately dried. When the secondary recrystallization starting temperature was measured after the holding time of 40 hours, it was 849° C. at the end portion having the amount of S+Se of 1.6%, 862° C. at the portions having the amount of S+Se of 0.45% and 886° C. at the central portion.

The $B_8$ value as a magnetic property of the thus obtained sheet product was measured to obtain a result as shown below. For the comparison, the $B_8$ value of a sheet product obtained at the usual steps without using iron sulfide and anhydrous selenic acid is also shown below.

| | $B_8$ (T) |
|---|---|
| Example | 1.956 |
| Comparative Example | 1.887 |

EXAMPLE 9

A hot rolled sheet of silicon steel containing C: 0.054%, Si: 3.28%, Mn: 0.087%, Si 0.0285, sol Al: 0.033% and N: 0.0080% and having a thickness of 2.4 mm was annealed at 1,000° C. for 2 minutes, pickled, cold rolled to a final sheet gauge of 0.27 mm, degreased, subjected to decarburization annealing in a wet hydrogen atmosphere, coated with a slurry of an annealing separator mainly composed of MgO, dried, heated by raising the temperature of 1,200° C. at a rate of 20° C./hr in $H_2$ atmosphere, and then subjected to a finish annealing by holding this temperature for 10 hours.

In the annealing separator application step, immediately after the application of the separator mainly composed of MgO, strontium sulfate was stepwise applied to the sheet of 1,000 mm in width so that the concentration of S was changed from 0% at an end portion of the sheet having a width of 100 mm through 1.50% at a portion ranging from this end portion to 450 mm in the widthwise direction to 3.5% at the other remaining end portion having a width of 450 mm, and dried.

After the holding annealing for 20 hours, $T_{SR}$ in the widthwise direction of the coil was measured to be 1,090° C. at the one end portion having the S amount of 0%, 1,040° C. at the central portion having the S amount of 1.50% and 1,050° C. at the other end portion having the S amount of 3.5%. The sheet was placed in a box type finish annealing furnace provided at its floor with a heater and giving a temperature gradient of 5° C./cm, wherein the end portion of the sheet having the S amount of 0% was located on the furnace floor, and then subjected to a finish annealing in $H_2$ atmosphere, wherein the temperature was raised to 1,200° C. at a rate of 20° C./hr and held for 10 hours.

The $B_8$ values as a magnetic property of the thus obtained sheet product was measured to obtain a result as mentioned below. For the comparison, the $B_8$ value of a sheet product obtained in the conventional manner is also shown below.

| | $B_8$ (T) |
|---|---|
| Example | 1.975 |
| Comparative Example | 1.933 |

EXAMPLE 10

A hot rolled sheet of silicon steel containing C: 0.040%, Si: 3.35%, Mn: 0.070%, Se: 0.020% and Sb: 0.025% and having a thickness of 2.2 mm was annealed at 950° C. for 2 minutes, picked, subjected to a first cold rolling to a thickness of 0.60 mm and to an intermediate annealing at 970° C. for 1.5 minutes, cold rolled to a final sheet gauge of 0.22 mm, degreased, subjected to decarburization and primary recrystallization annealing in a wet hydrogen atmosphere, coated with a slurry of an annealing separator mainly composed of MgO, dried, heated at a temperature rising rate of 2.5° C./hr over a range of 820°~925° C., and subjected to purification annealing in a dry hydrogen atmosphere at 1,200° C. for 10 hours. Then, the sheet was pickled to remove oxide film therefrom, subjected to a chemical polishing with a mixed solution of 3% Hf and $H_2O_2$ to render the surface into a mirror state, and treated in an atmosphere of $TiCl_4$ gas (70%) through CVD to form TiN coating of 0.8 μm in thickness on the sheet surface.

In the annealing separator application step, immediately after the application of the separator mainly composed of MgO, iron sulfide was stepwise applied to the sheet so that the amount of S was 0% at an end portion ($\frac{1}{4}$) of the sheet, 0.75% at a portion ranging from the end to 2/4 in the widthwise direction, 1.5% at a portion ranging from the 2/4 portion to $\frac{3}{4}$ in the widthwise direction and 2.25% at the other remaining end portion, and dried.

After the holding time of 20 hours, the secondary recrystallization starting temperature was measured to be 903° C. at the end portion having the S amount of 0%, 888° C. at the 2/4 portion, 873° C. at the $\frac{3}{4}$ portion and 858° C. at the other end portion. As a result, the temperature rising was carried out over a range of 820°~925° C. at a rate of 2.5° C./hr in a box type finish annealing furnace so as to adjust a temperature gradient from the one end of the sheet to the other end thereof to 2.5° C./cm.

The magnetic properties $B_8$ (T) and $W_{17/50}$ (W/kg) of the thus obtained grain oriented silicon steel sheet were measured to obtain results as mentioned below.

For the comparison, the measured magnetic properties of a sheet product obtained at the conventional steps without using iron sulfide are also shown below.

| | $B_8$ (T) | $W_{17/50}$ (W/kg) |
|---|---|---|
| Example | 1.988 | 0.60 |
| Comparative Example | 1.902 | 0.89 |

What is claimed is:

1. A method of producing a grain oriented silicon steel sheet having excellent magnetic properties by a series of steps of hot rolling a slab of silicon containing steel, subjecting the hot rolled sheet to a heavy cold rolling step or to a combination of two cold rolling steps and an intermediate annealing between the two cold rolling steps to obtain a final sheet gauge, subjecting the cold rolled sheet to decarburization and primary recrystallization annealing, applying a slurry of an annealing separator to the surface of the steel sheet, and thereafter subjecting the steel sheet to a secondary recrystallization annealing and further to a purification annealing, characterized in that at a stage before the secondary recrystallization annealing step, treating the sheet to form a region having a gradient of starting temperature for secondary recrystallization ($T_{SR}$) in widthwise and/or longitudinal directions of the sheet wherein said gradient is continuous and/or stepwise and wherein difference in $T_{SR}$ across the gradient is in a range of 10° C. to 200° C.

2. The method according to claim 1, wherein said treating comprises an annealing step carried out, either before the heavy cold rolling step or as said intermediate annealing, under a condition that the annealing temperature is continuously and/or stepwise varied in the widthwise direction and/or longitudinal direction of the sheet to form said $T_{SR}$ gradient.

3. The method according to claim 1, wherein said treating comprises forming a gradient of carbon content in the widthwise direction and/or longitudinal direction of the sheet continuously and/or stepwise over a range of 0.002–0.05 wt % at a stage before the decarburization and primary recrystallization annealing so as to obtain a difference in carbon content in the sheet of not less than two times to form said $T_{SR}$ gradient.

4. The method according to claim 1, wherein said treating comprises, at the decarburization and primary recrystallization annealing step, heating a first region of the sheet at a temperature rising rate of not lower than 10° C./sec and heating a second region of the sheet at a temperature rising rate of lower than 10° C./sec or holding the second region at a temperature within a range of 550°-750° C. for not less than 10 seconds but less than 10 minutes in the course of heating the second region to form said $T_{SR}$ gradient.

5. The method according to claim 1, wherein said treating comprises, at the step of applying said annealing separator, including at least one of S, Se and a compound thereof in said annealing separator, and applying said separator to form regions having a concentration difference of S and/or Se in said annealing separator of not less than 0.01% stepwise and/or to form regions having a continuous concentration gradient of S and/or Se of at least 0.005% per 10 cm, said regions being in the widthwise direction and/or longitudinal direction of the sheet to form said $T_{SR}$ gradient.

6. The method according to any one of claims 1~5, wherein said secondary recrystallization annealing is performed by heating at a temperature rising rate of not more than 10° C./hr from a minimum temperature starting said secondary recrystallization of the sheet till the completion of said secondary recrystallization.

7. The method according to any one of claim 1~5, wherein said secondary recrystallization annealing is performed by uniformly holding temperature at a range of minimum temperature starting said secondary recrystallization of the sheet till the completion of said secondary recrystallization.

8. The method according to any one of claim 1~5, wherein said secondary recrystallization annealing is performed by such a temperature gradient annealing that said secondary recrystallization is started from an end portion of the sheet having a high secondary recrystallization starting temperature at a temperature gradient larger than a gradient of said secondary recrystallization starting temperature in the sheet.

9. The method according to any one of claims 1~5, wherein said secondary recrystallization annealing is performed by such a temperature gradient annealing that said secondary recrystallization proceeds from an end portion of the sheet having a low secondary recrystallization starting temperature while giving a temperature gradient to the sheet.

10. The method according to claim 8, wherein said temperature in said temperature gradient annealing is not lower than 2° C. per unit length of the sheet of 1 cm.

11. The method according to claim 9 wherein said temperature in said temperature gradient annealing is not lower than 2° C. per unit length of the sheet of 1 cm.

* * * * *